US011519119B2

(12) United States Patent
Lee et al.

(10) Patent No.: US 11,519,119 B2
(45) Date of Patent: Dec. 6, 2022

(54) DRUM OF WASHING MACHINE

(71) Applicant: LG Electronics Inc., Seoul (KR)

(72) Inventors: Sangwook Lee, Seoul (KR); Youngjong Kim, Seoul (KR); Miju Kim, Seoul (KR); Hyewon Kim, Seoul (KR); Hoil Jeon, Seoul (KR); Hyungkwan Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 1173 days.

(21) Appl. No.: 16/002,406

(22) Filed: Jun. 7, 2018

(65) Prior Publication Data

US 2018/0355538 A1 Dec. 13, 2018

(30) Foreign Application Priority Data

Jun. 8, 2017 (KR) ..... 10-2017-0071773
Jun. 8, 2017 (KR) ..... 10-2017-0071774

(51) Int. Cl.

| | |
|---|---|
| ***D06F 37/02*** | (2006.01) |
| ***D06F 25/00*** | (2006.01) |
| ***D06F 37/06*** | (2006.01) |
| ***D06F 37/04*** | (2006.01) |
| ***D06F 37/12*** | (2006.01) |

(52) U.S. Cl.
CPC ..... *D06F 37/02* (2013.01); *D06F 25/00* (2013.01); *D06F 37/04* (2013.01); *D06F 37/06* (2013.01); *D06F 37/12* (2013.01)

(58) Field of Classification Search
CPC ..... D06F 37/02; D06F 37/04; D06F 37/06; D06F 37/12; D06F 25/00
USPC ..... 68/12.14
See application file for complete search history.

(56) References Cited

U.S. PATENT DOCUMENTS 6,221,299 B1 * 4/2001 Mirtsch ..... B29C 49/00 72/196
6,334,341 B1 * 1/2002 Hellhake ..... D06F 37/04 68/124
8,256,248 B2 * 9/2012 Jeong ..... D06F 37/02 68/3 R (Continued)

FOREIGN PATENT DOCUMENTS

CN 1608157 4/2005
CN 101476229 7/2009

(Continued)

OTHER PUBLICATIONS

Wildung et al., "Drum for a linen processing machine with a domed structure directed toward the inside of said drum" Jul. 2003, WO-03054275—Machine Translation (Year: 2003).*

(Continued)

*Primary Examiner* — David G Cormier
*Assistant Examiner* — Thomas Bucci
(74) *Attorney, Agent, or Firm* — Fish & Richardson P.C.

(57) ABSTRACT

A drum of a washing machine, which is configured to receive laundry and to perform washing or dehydration, includes a circumferential surface that defines a plurality of first patterns that protrude from the circumferential surface toward an interior of the drum, a second pattern that is recessed from the circumferential surface toward an exterior of the drum and that is surrounded by the plurality of first patterns, and a through hole located at the second pattern.

19 Claims, 12 Drawing Sheets

(56) References Cited

U.S. PATENT DOCUMENTS

| | | | | |
|---|---|---|---|---|
| 8,752,292 | B2 * | 6/2014 | Mirtsch | B30B 3/005 29/896.62 |
| D722,733 | S * | 2/2015 | Kim | D32/29 |
| 9,951,453 | B2 * | 4/2018 | Jeon | D06F 37/145 |
| 2008/0006065 | A1 * | 1/2008 | Fumagalli | D06F 37/04 68/235 R |
| 2008/0202171 | A1 * | 8/2008 | Park | D06F 37/04 68/23.5 |
| 2010/0058589 | A1 * | 3/2010 | Mirtsch | B01D 33/52 72/196 |
| 2013/0047679 | A1 * | 2/2013 | Cinello | D06F 37/02 72/335 |
| 2013/0213097 | A1 * | 8/2013 | Kim | D06F 37/065 68/140 |
| 2014/0096570 | A1 * | 4/2014 | Jang | D06F 37/06 68/142 |
| 2014/0096571 | A1 * | 4/2014 | Jang | D06F 37/06 68/142 |
| 2015/0252512 | A1 * | 9/2015 | Jeon | D06F 37/145 68/132 |

FOREIGN PATENT DOCUMENTS

| | | | | |
|---|---|---|---|---|
| CN | 102884238 | | 1/2013 | |
| CN | 103820973 | | 5/2014 | |
| CN | 106367923 | | 2/2017 | |
| DE | 102012204560 | | 9/2013 | |
| EP | 1028189 | A2 * | 8/2000 | D06F 37/02 |
| EP | 1876280 | A1 * | 1/2008 | D06F 37/04 |
| EP | 1925704 | A1 * | 5/2008 | D06F 37/02 |
| EP | 2372010 | | 10/2011 | |
| EP | 2386677 | A1 * | 11/2011 | D06F 37/02 |
| EP | 2455531 | | 5/2012 | |
| EP | 2455531 | A1 * | 5/2012 | D06F 37/02 |
| EP | 2719808 | A1 * | 4/2014 | D06F 37/02 |
| EP | 2832916 | A1 * | 2/2015 | D06F 37/02 |
| EP | 3412823 | A1 * | 12/2018 | D06F 25/00 |
| JP | 2007-054351 | | 3/2007 | |
| KR | 10-2002-0093274 | | 12/2002 | |
| KR | 10-2004-0068235 | | 7/2004 | |
| KR | 20130095604 | | 8/2013 | |
| KR | 10-2014-0046981 | | 4/2014 | |
| KR | 1020140046718 | | 4/2014 | |
| KR | 10-2015-0105092 | | 9/2015 | |
| WO | 2003/054275 | | 7/2003 | |
| WO | WO-03054275 | A1 * | 7/2003 | D06F 37/02 |
| WO | 2013/030394 | | 3/2013 | |

OTHER PUBLICATIONS

CN Office Action in Chinese Appln. No. 201880044754.3, dated Mar. 25, 2021, 14 pages (with English translation).

KR Office Action in Korean Appln. No. 10-2017-00711774, dated May 13, 2021, 9 pages (with English translation).

European Office Action in European Application No. 18175923.4, dated Jun. 30, 2020, 5 pages.

European Search Report in European Application No. 18175923.4, dated Nov. 6, 2018, 8 pages.

International Search Report and Written Opinion in International Application No. PCT/KR2018/006462, dated Sep. 13, 2018, 12 pages (English Translation).

Notice of Allowance in Chinese Appln. No. 201880044754.3, dated Sep. 13, 2021, 9 pages (with English translation).

Notice of Allowance in Korean Appln. No. 10-2022-0022917, dated May 22, 2022, 3 pages (with English translation).

* cited by examiner

DRUM OF WASHING MACHINE

CROSS-REFERENCE TO RELATED APPLICATIONS

This application claims the benefit of the Korean Patent Application No. 10-2017-0071773, filed on Jun. 8, 2017 and No. 10-2017-0071774, filed on Jun. 8, 2017 which is hereby incorporated by reference as if fully set forth herein.

FIELD

The present disclosure relates to a washing machine, and more particularly, to a drum provided in a washing machine.

BACKGROUND

A washing machine can wash laundry by providing mechanical action and chemical action to laundry.

For example, a washing machine may receive laundry in a drum and wash the received laundry by physical impact generated between the drum and the laundry, physical impact generated between the laundry and another laundry, and physical impact generated between washing water and the laundry.

In some examples, washing may be performed by soaking laundry in washing water with detergent, which provides chemical action to decompose and separate a contaminant from laundry.

In some examples, a washing machine, which may perform washing and dehydration through a drum, includes the drum inside of a tub. The drum may define through holes on a circumferential surface of the drum to allow flow of washing water between the drum and the tub through the through holes. The through holes may have a small size so as not to allow laundry to enter the drum therethrough.

When washing water is supplied to the tub, the washing water may enter the drum through the through holes, and movement of washing water and movement of the laundry may be generated through rotation of the drum.

Dehydration of the laundry may be performed by driving the drum at a relatively high rotation per minute (RPM). While rotation of the drum, laundry may be kept in the drum, but washing water can move out of the drum through the through holes. For example, washing water may be separated from laundry by centrifugal force and then enter the tub through the through holes. The washing water entered the tub may be discharged to an outside of the washing machine.

Although the washing machine that performs washing and dehydration through the same drum is described for an example, a washing machine that performs only dehydration or washing may be provided. In some examples, a washing machine that mainly performs dehydration may be referred to as a dehydrating apparatus or a dehydrator.

It is important to enhance a dehydrating ratio in the drum in which dehydration of laundry is performed by centrifugal force. For example, while the drum is rotated by the same RPM for the same time period, a dehydrating ratio may be enhance by reducing a water content ratio remaining in the laundry. That is, enhancing a dehydrating effect or dehydrating ratio is of interest while using the same energy. Enhancing a dehydrating ratio may improve efficiency of the washing machine, and reduce time and energy for drying laundry.

For example, a dryer that dries laundry using a heat source after dehydration may reduce a drying time or drying energy if a water content ratio has been lowered by dehydration.

This dehydration may include intermediate dehydration performed during a washing or rinsing step as well as final dehydration performed at a final step of a washing course. In some examples, a water content ratio may be reduced in an intermediate dehydration step. In some examples, washing effect or rinsing effect may be enhanced when more contaminant or contaminated washing water is discharged during the intermediate dehydration step. Also, since the amount of washing water required for rinsing may be reduced or rinsing times may be reduced, it may be very efficient.

If washing water inside the drum is discharged through holes formed on a circumferential surface of the drum, a size of holes may be considered. If the through holes have a big size, a discharge area of the washing water may be increased, whereby dehydration effect may be increased.

However, laundry is adhered to an inner circumferential surface of the drum by centrifugal force during dehydration, and some of the laundry adhered to the inner circumferential surface of the drum may enter the through holes. Therefore, a strong tensile force may be generated at a specific portion of the laundry, whereby the laundry may be damaged. This strong tensile force may cause permanent deformation or damage on the laundry.

Therefore, there is limitation in enhancing dehydrating effect by increasing the size of the through hole.

In some examples, dehydrating effect may be enhanced by increasing dehydrating RPM. However, there is also limitation in increasing dehydrating RPM due to a size of the drum, vibration caused by unbalance of laundry inside the drum and limitation of a motor for driving the drum.

In some examples, it may be important to enhance dehydrating efficiency. However, it is also important to prevent laundry from being damaged. Therefore, it is necessary to satisfy both dehydrating efficiency and damage prevention of laundry. That is, it is necessary to provide a drum and a washing machine comprising the same, in which dehydrating efficiency may be reduced and laundry may be prevented from being damaged as compared with the washing machine of the related art.

Correlation between the through holes and the dehydrating ratio may be described as follows.

Three types of water may exist inside the drum.

First, water is absorbed in the laundry, in which water may be located between a fiber texture and another fiber texture. For example, water may be located between cotton yarns, and may be referred to as free water, which may be separated from a fiber texture by a centrifugal force.

Second, water may be inside of a fiber tissue, and may be located inside a cotton yarn, for instance. Compact filaments may be provided inside the cotton yarn, and water may be located between the filaments. This type of water may be referred to as bound water. The bound water may be separated by phase change of water, and it may be difficult to separate water from a fiber by physical force such as centrifugal force.

Third, water may be separated from a fiber tissue, and blocked by an inner wall of a drum. This type of water may be referred to as stagnant water. To discharge this stagnant water from the drum, rotation of the drum for a certain time period or more may be required. In some examples, the stagnant water may not be drained and absorbed again in laundry, which may deteriorate a dehydration level.

FIG. 1 is a conceptual view briefly illustrating a dehydrating principle in a drum of the related art.

If a drum 10 is rotated at a high speed for dehydration, laundry 20 located inside the drum 10 is adhered to an inner circumferential surface 11 of the drum due to centrifugal force 40. The water 30 moves to the outside in a radius direction due to the centrifugal force 40. Water that has reached the inner circumferential surface 11 of the drum may move along the inner circumferential surface of the drum by tangent inertial force 60, and may be discharged to the outside of the drum 10 after being in contact with through holes 13.

In some examples, a change of a water content ratio inside the laundry may be generated based on water movement due to a capillary phenomenon. Since the water content ratio of the laundry is lowered at the outside of the radius direction and near the through holes, water may be likely to move to laundry near the through holes based on the capillary phenomenon.

In some cases, if the periphery of the through holes has a flat shape, the laundry is likely to be inserted into the through holes 13, which may cause damage and deformation of the laundry. That is, if a contact frequency or probability between the laundry and the through holes is increased, damage of the laundry is increased. FIG. 1 illustrates that a part 21 of the laundry is taken out toward the outside of the through holes 13. That is, FIG. 1 illustrates that the laundry is taken out toward the outside of the radius direction further away than an outer circumferential surface 12 of the drum.

If the stagnant water fails to meet the through holes while moving along the inner circumferential surface 11 of the drum, the stagnant water remains in the drum 10, and thus a rotation time of the drum may be increased.

There may be two types of drums: the drum that is rotated about a vertical axis with respect to the ground (for example, top-loader washing machine) and the drum that is rotated about a horizontal axis with respect to the ground (for example, front-loader washing machine). In both types of drums, water separated by centrifugal force may be discharged to the outside of the drum through the through holes.

SUMMARY

Accordingly, the present disclosure is directed to a drum and a washing machine comprising the same that substantially obviates one or more problems due to limitations and disadvantages of the related art.

An object of the present disclosure is to provide a drum and a washing machine comprising the same that may enhance dehydrating efficiency and effectively reduce damage of laundry.

Another object of the present disclosure is to provide a drum and a washing machine comprising the same that may be easy to be manufactured.

Still another object of the present disclosure is to provide a drum and a washing machine comprising the same that may enhance dehydrating effect by reducing reabsorption of washing water separated from laundry into the laundry.

Further still another object of the present disclosure is to provide a drum and a washing machine comprising the same that may reduce damage of laundry by structurally reducing contact frequency or contact probability between the laundry and through holes.

Further still another object of the present disclosure is to provide a drum and a washing machine comprising the same that may enhance dehydrating effect by minimizing generation of stagnant water by allowing water to meet through holes while easily moving along an inner circumferential surface of the drum. That is, further still another object of the present disclosure is to provide a drum and a washing machine comprising the same that may effectively perform water discharge by forming a moving path of water in various patterns and forming through holes on the moving path.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a drum of a washing machine in which laundry is received to perform washing or dehydration according to one implementation comprises a plurality of octagonal patterns formed to be embossed on a circumferential surface of the drum; a square pattern formed on the circumferential surface of the drum and surrounded by four of the plurality of octagonal patterns; and a main through hole formed in the square pattern.

The octagonal pattern may be formed in a regular octagonal shape, and the square pattern may be formed in a square shape.

Four sides of the square pattern may be formed through the four octagonal patterns surrounding the square pattern.

The octagonal pattern may be formed to be embossed toward an inner side of the drum, and the square pattern may be formed to be engraved toward an outer side of the drum.

The octagonal pattern may have an area greater than that of the square pattern, and its protrusion length may be longer than that of the square pattern.

The side of the octagonal pattern and the side of the square pattern may form a reference surface of the drum, and the octagonal pattern may be formed to be embossed on the reference surface, and the square pattern may be formed to be engraved on the reference surface.

One side of the octagonal pattern and one side of the square pattern may be the same as each other. That is, the one side may be shared between the octagonal pattern and the square pattern. In this case, the shared side forms a reference surface of the drum. That is, an inner side of the shared side may form a reference inner circumferential radius of the drum, and an outer side of the shared side may form a reference outer circumferential radius of the drum. In other words, the shared side may be a portion where engraved and embossed patterns are not formed.

In some implementations, the octagonal pattern is formed to have a protrusion length which is the longest at the center. The octagonal pattern may be inclined from the center to the outer side. Therefore, water on the octagonal pattern may flow toward the outer side of the octagonal pattern by inclination of the pattern.

In some implementations, the octagonal pattern may be inclined to have a straight line, a curved line or combination of the straight line and the curved line from one side of the octagonal pattern to the center of the octagonal pattern.

Any one of the four octagonal patterns surrounding the square pattern may share one side with two adjacent octagonal patterns. Any one of the four octagonal patterns may be spaced apart from two adjacent octagonal patterns.

A sub through hole may be formed at the side shared by the two octagonal patterns.

In some implementations, the square pattern may be formed to have a protrusion length which is the longest at the center.

In some implementations, the square pattern may be inclined to have a straight line, a curved line or combination of the straight line and the curved line from one side of the square pattern to the center of the octagonal pattern. Therefore, water on the square pattern may flow to the center of the square pattern through the inclination.

In some implementations, the main through hole may be formed at the center of the square pattern. Therefore, the water flowing to the center of the square pattern may easily be discharged to the outside through the main through hole.

In some implementations, a through hole extension portion surrounding the main through hole is formed on an outer circumferential surface of the drum, and a length of the through hole is more increased than a thickness of the circumferential surface of the drum by the through hole extension portion. In some examples, a pipe or a capillary tube surrounding the through hole is located at the outside of the drum. Water inside the drum may more actively be discharged to the outside of the drum by a capillary phenomenon.

The square pattern, the octagonal pattern and the main through hole may continuously be formed in a plural number along a circumferential direction and a length direction of the drum to form a pattern group.

The pattern group may be formed in a plural number along the circumferential direction of the drum, and a dummy pattern group from which the pattern group formation is excluded may be formed between the pattern group and the pattern group. Another type pattern different from the pattern group may be formed in the dummy pattern.

In some implementations, the pattern group is excluded at both ends in a length direction of the drum.

In some implementations, the dummy pattern group is provided with a plurality of dummy through holes.

The drum of a washing machine may be formed by coupling both ends by rolling a metal plate provided with a plurality of pattern groups.

Two sides of the square pattern may be formed to be orthogonal to a rotary shaft of the drum and the other two sides may be formed to be parallel with the rotary shaft of the drum.

An inner pattern of an engraved pattern protruded toward the outside of the drum may be formed in a circle or polygonal shape. That is, an inner pattern of a circle or polygonal shape smaller than the square pattern may be formed inside the square pattern. The inner pattern may be engraved.

In some implementations, the main through hole is formed at the center of the engraved pattern of a circle or polygonal shape. The engraved pattern may be inclined from an edge portion of the circle or polygonal shape to a center portion. A horizontal surface of a certain area may be formed at the center portion of the inner pattern.

In some implementations, the engraved pattern of a circle or polygonal shape has a protrusion length which is the longest at the center.

An edge of the inner pattern may be formed at an inner side of an edge of the square pattern, and a horizontal portion from which engraved and embossed patterns are excluded may be formed between the edge of the square pattern and the edge of the inner pattern.

An inclined shape may be varied based on a section for connecting the center of the octagonal pattern with the center of the square pattern. A downward inclination (inclined toward outside of the drum) may be formed from the center of the octagonal pattern to the outside of the octagonal pattern, and a horizontal surface may be formed between the outside of the octagonal pattern and the outside of the inner pattern. Also, a downward inclination may be formed from the outside of the inner pattern to the center of the inner pattern. The octagonal pattern may be formed to be embossed and the inner pattern may be formed to be engraved. Therefore, since the horizontal surface is provided between the embossed pattern and the engraved pattern, the embossed and engraved patterns may easily be formed.

At least any one of eight sides of the octagonal pattern may be formed in a curved type or a type of two straight lines crossing at an obtuse angle. That is, the octagonal pattern may not have an octagonal shape geometrically. That is, the octagonal pattern may have an approximate octagonal shape.

Corners of the octagonal pattern may be formed in a round type not an angulated type. Therefore, the corners of the octagonal pattern may be opened types through the rounded type instead of the type that two sides cross.

The shape of the square pattern may be varied by the side shape of the octagonal pattern. For example, if the side of the octagonal pattern is a curved type or a type of two straight lines crossing at an obtuse angle, the side of the square pattern may be formed by the side of the octagonal pattern. That is, the side of the square pattern may be a curved type or a type of two straight lines crossing at an obtuse angle.

The side of the curved type or the side of the type of two straight lines may form any one side of the square pattern adjacent to the octagonal pattern.

A horizontal portion from which engraved and embossed patterns are excluded may be formed between the octagonal pattern and another octagonal pattern. The octagonal pattern may be spaced apart from another octagonal pattern by the horizontal portion. The horizontal portion may form a path through which water moves. Therefore, a sub through hole may be formed in the horizontal portion. In some implementations, the sub through hole is formed at the center portion in a length direction of the horizontal portion.

A diagonal type engraved pattern of which protrusion length is the longest at the center may be formed inside the square pattern. That is, the engraved pattern may be formed in a type of two lines for connecting facing corners. The diagonal type engraved pattern may form a path where water moves from the outside of the inner pattern to the center of the inner pattern. That is, in addition to the inclined surface, an inclined line or inclined way type path may be formed to discharge water to the main through hole more actively.

In some implementations, the main through hole may be formed at the center of the square pattern, and its size is greater than that of the sub through hole formed at a portion where the octagonal pattern is adjacent to another octagonal pattern.

According to one aspect of the subject matter described in this application, a drum of a washing machine, which is configured to receive laundry and to perform washing or dehydration, includes a circumferential surface that defines a plurality of first patterns that protrude from the circumferential surface toward an interior of the drum, a second pattern that is recessed from the circumferential surface toward an exterior of the drum and that is surrounded by the plurality of first patterns, and a through hole located at the second pattern.

Implementations according to this aspect may include one or more of the following features. For example, an area of the plurality of first patterns may be greater than an area of the second pattern. The circumferential surface of the drum may further define a third pattern that surrounds the second pattern and that is surrounded by the plurality of first patterns. In some examples, an edge of the third pattern may be spaced apart from an edge of the second pattern. The edge of the third pattern and the edge of the second pattern may be flat without a protrusion or a recess from the circumferential surface of the drum.

In some implementations, the plurality of first patterns may be arranged about the second pattern and contact each other. The circumferential surface of the drum may further define a sub through hole at a contact portion between two first patterns of the plurality of first patterns. In some examples, the plurality of first patterns may be arranged about the second pattern and spaced apart from each other. The circumferential surface of the drum may further define a sub through hole at a space defined between two first patterns of the plurality of first patterns that face each other.

In some implementations, each first pattern may have an octagonal shape. In some examples, the circumferential surface of the drum may further define a third pattern that has a square shape, that is surrounded by the plurality of first patterns, and that surrounds the second pattern.

In some implementations, each first pattern may have a hexagonal shape. In some examples, the circumferential surface of the drum may further define a third pattern that has a hexagonal shape, that is surrounded by the plurality of first patterns, and that surrounds the second pattern.

In some implementations, the through hole is defined at a center of the second pattern. In some examples, the through hole may extend from the circumferential surface toward an exterior of the drum to an outermost position of the second pattern by a protrusion length.

In some implementations, an edge of the second pattern may have a circular or polygonal shape. In some examples, the second pattern may have a cone shape or a ladder shape that is recessed from the circumferential surface toward an exterior of the drum.

In some implementations, the circumferential surface of the drum may include a recessed surface that has a same shape as an edge region of the second pattern, where an area of the recessed surface is less than an area of the edge region of the second pattern. In some examples, the through hole may be located at a center of the recessed surface.

Through the washing machine comprising the drum, dehydrating effect may be more enhanced, whereby user satisfaction may be enhanced. If dehydrated laundry is dried through a dryer, drying energy may be more reduced. Furthermore, damage of the laundry may be reduced during washing or dehydration, whereby user satisfaction may be more enhanced.

According to one implementation of the present disclosure, a drum and a washing machine comprising the same may be provided, which may enhance dehydrating efficiency and effectively reduce damage of laundry.

According to one implementation of the present disclosure, a drum and a washing machine comprising the same may be provided, which may be easy to be manufactured.

According to one implementation of the present disclosure, a drum and a washing machine comprising the same may be provided, which may enhance dehydrating effect by reducing reabsorption of washing water separated from laundry into the laundry.

According to one implementation of the present disclosure, a drum and a washing machine comprising the same may be provided, which may reduce damage of laundry by structurally reducing contact frequency or contact probability between the laundry and through holes.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate implementation(s) of the disclosure and together with the description serve to explain the principle of the disclosure.

DETAILED DESCRIPTION

Reference will now be made in detail to the example implementations of the present disclosure, examples of which are illustrated in the accompanying drawings. Wherever possible, the same reference numbers will be used throughout the drawings to refer to the same or like parts.

Hereinafter, a drum of a washing machine according to the implementation of the present disclosure will be described in detail with reference to the accompanying drawings.

A dehydrating principle of a drum according to one implementation of the present disclosure will be described with reference to FIG. 2.

As shown, in this implementation, a portion near a through hole 113 is not flat but inclined to move water along an inclination.

The inclination or gradient may mean that a circumferential surface of a drum is formed toward the outside of a radius direction in the through hole 113. In this case, the circumferential surface of the drum includes an inner circumferential surface 111 and an outer circumferential surface 112. If the drum 100 has a uniform thickness, the inner circumferential surface and the outer circumferential surface may substantially be formed in parallel.

The inclination or gradient may continuously be formed to reach the through hole 113, and may continuously be formed near the through hole.

This inclination or gradient may be formed in an engraved pattern based on the inner circumferential surface of the drum. That is, the through hole may be formed at a part of an engraved area, for example, a center portion of the engraved area. In some exampes, the entire engraved area is greater than a diameter of the through hole. This an area surrounding the through hole as well as the through hole may be formed in an engraved pattern, and the through hole may be formed at a part of the engraved area. Therefore, water entering the engraved area may very actively enter the through hole along the inclination. That is, if the engraved area is increased, more water enters the corresponding area, whereby stagnant water may be minimized.

Figure 1:
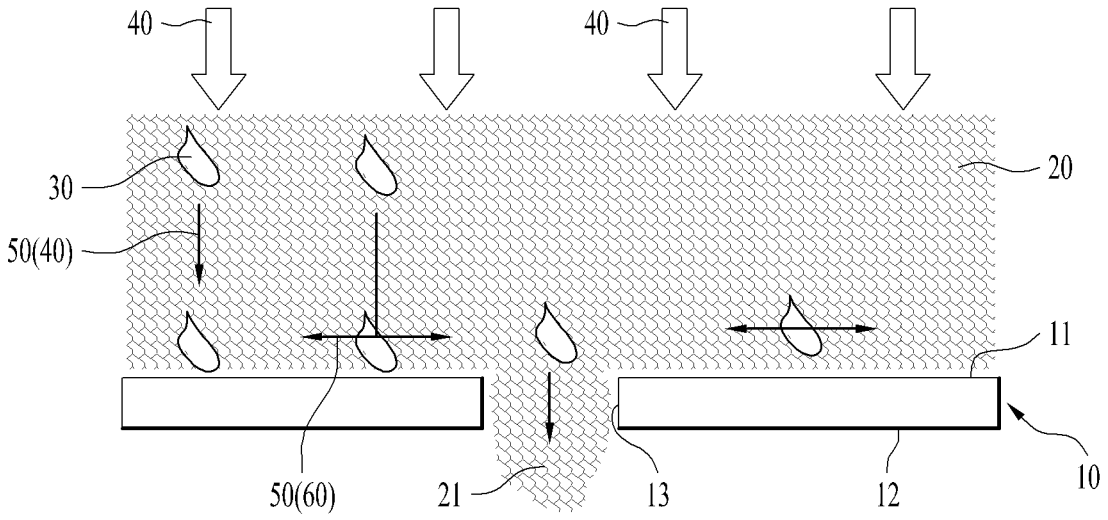
FIG. 1 is a brief view illustrating a shape of periphery through holes defined at a drum of related art and its dehydrating factors.
Figure 2:
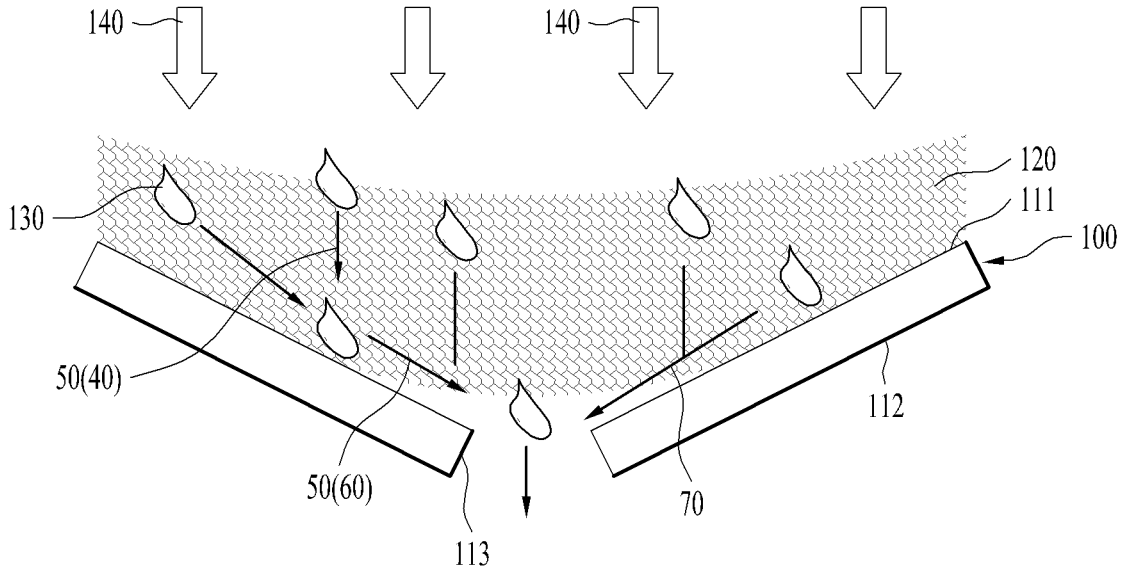
FIG. 2 is a brief view illustrating an example shape of through holes defined at a drum and its dehydrating factors according to one implementation of the present disclosure.

In detail, in comparison between the flat structure shown in FIG. 1 and the inclined structure shown in FIG. 2, it is noted from the latter case that water may easily move along the inclination. Therefore, the stagnant water may move toward the through hole without simply moving along the inner circumferential surface of the drum.

Therefore, for water discharge, a centrifugal force 40, a capillary phenomenon 50 and a tangent inertial force 60 may be used, and also movement or force 70 through inclination gradient may be used. Therefore, the stagnant water may be removed more effectively than the same dehydrating condition (RPM and rotation time). When a laundry 120 is adhered to the inner circumferential surface 11 of the drum, the laundry is headed for a through hole. Therefore, as shown in FIG. 1, it is noted that the laundry which directly covers the through hole may easily be inserted into the through hole by a centrifugal force. However, since the laundry is spaced apart from the through hole in FIG. 2, it is not likely that the laundry may be inserted into the through hole 113 even though the laundry moves toward the through hole by centrifugal force, or an insertion length is remarkably small even though the laundry is inserted into the through hole. Therefore, since a contact frequency between the laundry and the through hole may be lowered remarkably, damage of the laundry may be reduced remarkably.

In accordance with this inclination structure, as shown in FIG. 2, the size of the through hole may be more increased than the size of the through hole shown in FIG. 1. Even though the size of the through hole is finely increased, it may effectively contribute to enhancement of a dehydrating ratio.

Hereinafter, one implementation of the present disclosure to which the inclination structure of the drum shown in FIG. 2 is applied will be described in detail.

The drum of the washing machine may be formed to have various materials and various shapes. However, it is general that the drum is formed of a metal material considering strength, sanitation, weight and productivity. Particularly, it is general that the drum is manufactured using a plate of a stainless material.

A plate 200 of a thin plate shape is bent to form a cylindrical shape, whereby the outer circumferential surface of the drum is formed. The outer circumferential surface of the drum may be formed in a cylindrical shape.

The structure of the drum may be categorized into a drum front, a drum center and a drum rear in case of a front loader type drum. The drum front forms a space where laundry is inserted from the front of the drum, and the drum center forms a space where laundry is received to substantially perform washing or dehydrating. The drum rear has a structure that blocks the rear of the drum and may be connected with a driver for driving the drum through the drum rear.

In case of the top loader type drum, the structure of the drum may be categorized into a drum upper, a drum center and a drum lower, and the other details may be the same as or similar to those of the front loader type drum.

The drum front or the drum upper may be formed in a single body with the drum center. The drum rear and the drum lower are manufactured separately from the drum center and then may be coupled with each other.

Therefore, since washing or dehydration of the laundry may substantially be performed through the drum center, a pattern of an outer circumferential surface of the drum center may be very closely related with damage prevention of the laundry and a dehydrating ratio of the laundry.

In this respect, this implementation will be based on the drum center of the structure of the drum, and the drum center will hereinafter be described in detail.

Figure 3:
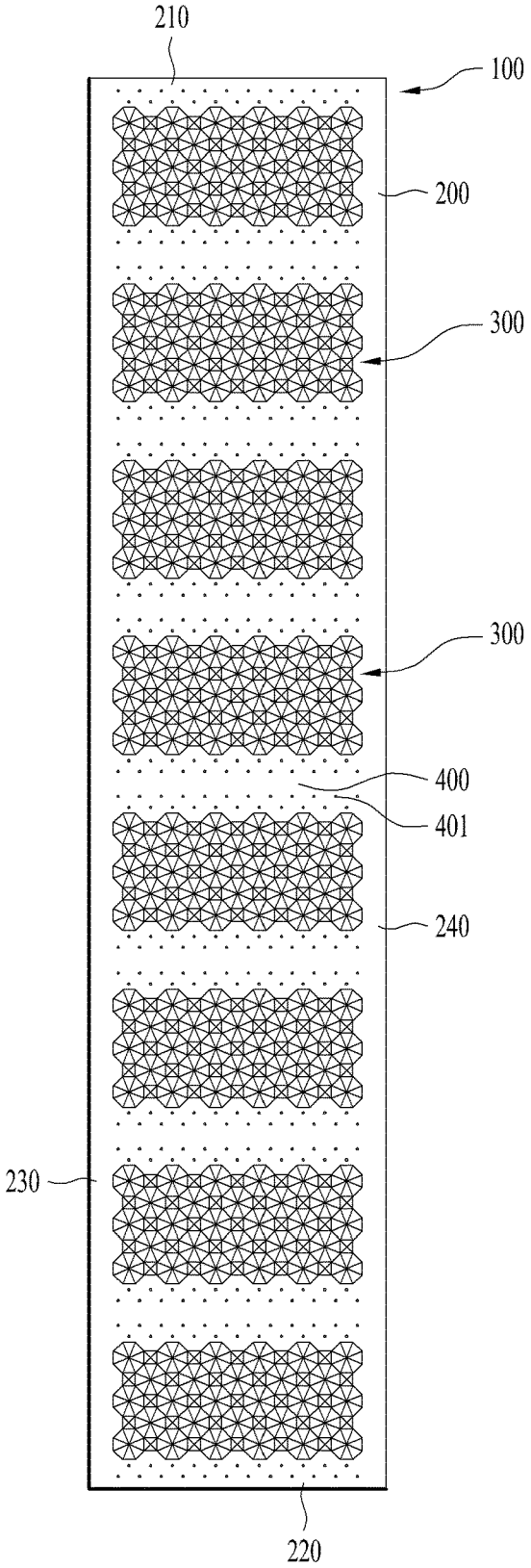
FIG. 3 is a view illustrating an example drum having example patterns.

FIG. 3 is an elevational view of the drum 100 and illustrates the inside of the drum. An upper end 210 and a lower end 220 of the plate 200 may be coupled with each other to form the cylindrical drum 100. The drum 100 may not be a cylindrical drum, and may be formed by rolling to have various sections (for example, oval shape, track shape, and polygonal shape) if necessary.

First of all, various patterns and a through hole may be formed in the drum 100. The through hole may be a part of the pattern. The pattern may be formed in an embossed and/or engraved pattern. This embossed or engraved pattern may be formed through a press processing. The through hole may be formed through a piercing process.

The press processing and the piercing processing may be performed by the same process. Therefore, the press processing and the piercing processing are performed for the plate 200 to from a pattern and a through hole, and then a bending process for bending the plate 200 may be performed. After the bending processing is performed, the upper end 210 and the lower end 220 of the plate may be coupled with each other by welding. Therefore, the production process of the drum may be simplified and facilitated.

If the upper end the lower end are coupled with each other based on the plate shown in FIG. 3, the drum 100 of which center shaft is horizontal may be formed. If this drum is erected, the drum of which center shaft is vertical may be formed. For convenience of description, description will be given based on the drum of which center shaft is horizontal.

Embossed and/or engraved patterns may be formed in the drum 100, and a pattern group 300 in which these patterns are regularly arranged may be formed. FIG. 3 illustrates an example that 8 pattern groups 300 are formed up and down.

In some implementations, a dummy pattern group 400 may be formed between the pattern group 300 and the pattern group 300. For example, a radius of the inner circumferential surface of the drum and a radius of the outer circumferential surface in the dummy pattern group 400 may be substantially constant. A dummy through hole 401 may be formed in the dummy pattern group 400.

Instead of the embossed or engraved pattern, a plurality of dummy through holes 401 may be formed in the dummy pattern group 400. The dummy through holes 401 may be formed in a certain arrangement. If the embossed or engraved patterns are not formed in the dummy pattern group 400, this may be referred to as a flat pattern, and the dummy through holes may be referred to as flat through holes. That is, no inclination may be formed toward the flat through holes in the periphery of the flat through holes.

In some implementations, the pattern group 300 may longitudinally be formed in a direction of the center shaft of the drum. That is, a left and right length may be longer than an up and down length. In other words, the pattern group 300 is formed longitudinally in a length direction of the drum. The pattern group 300 is formed to be relatively short in a circumferential direction of the drum.

The case that the up and down length and the left and right length of the drum pattern are different from each other is intended to sufficiently ensure the dummy pattern group 400. The dummy pattern group 400 may be an area where a lifter or baffle provided in the drum is provided. Since the lifter or baffle is apparent to the technical field of the washing machine, its detailed description will be omitted.

The dummy pattern group 400 may be formed at left and right ends 230 and 240 of the drum. However, no through hole may be formed in the dummy pattern group 400 of left and right ends. This is because that the drum front or the drum rear is formed at the left and right ends of the drum or the left and right ends of the drum are connected with the drum front or the drum rear.

In some implementations, the number and size of the pattern groups 300 may be varied depending on the size of the drum 100. Likewise, the number of dummy pattern groups provided between the pattern group and the pattern group may be varied depending on the number of the pattern groups 300.

Also, the dummy pattern group may be formed to satisfy roundness or a factor corresponding to the roundness when the drum is formed. That is, this is because that bending may not be easy if the dummy pattern group is only formed. In other words, desired roundness may not be satisfied. Therefore, desired roundness may be satisfied through the dummy pattern group.

Figure 4:
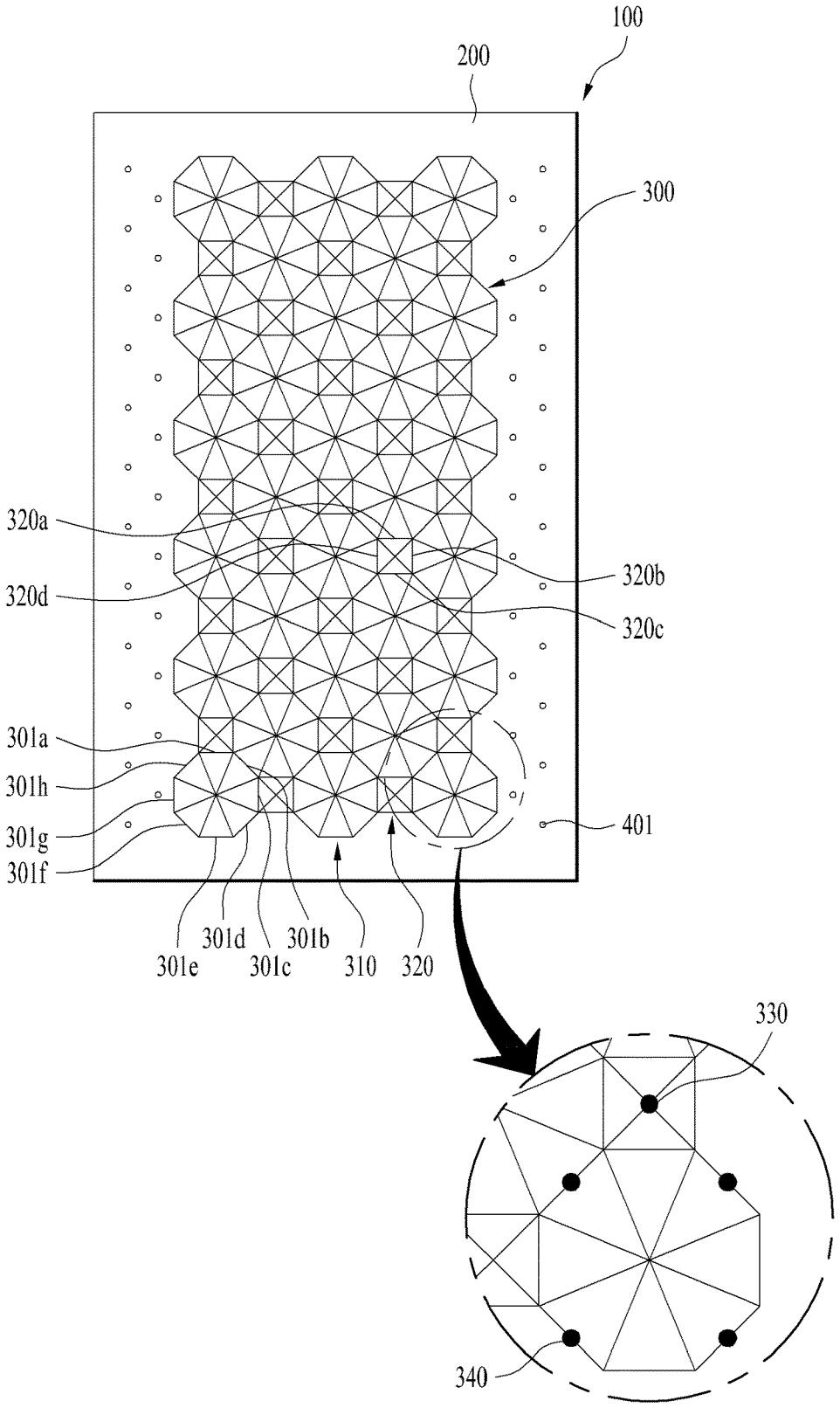
FIG. 4 is an enlarged view illustrating an example pattern group shown in FIG. 3.
Figure 5:
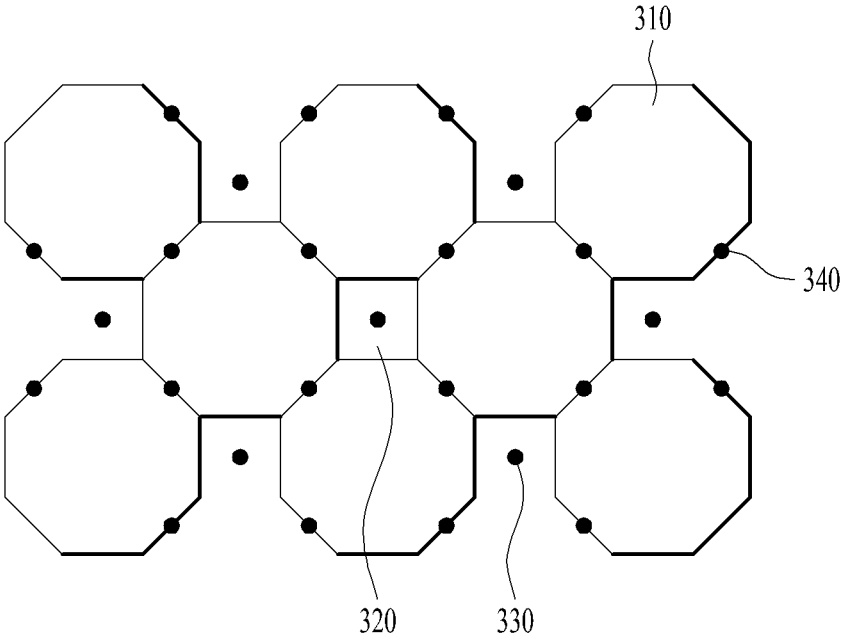
FIG. 5 is an enlarged view illustrating an example group pattern defined in an example drum.

Hereinafter, the aforementioned pattern group 300 will be described in detail with reference to FIGS. 4 and 5. FIG. 4 illustrates that any one of the pattern group 300 shown in FIG. 3 is rotated 90° clockwise. FIG. 5 illustrates that a part of the pattern group 300 is enlarged.

In this implementation, a plurality of embossed patterns 310 formed on the circumferential surface of the drum and an engraved pattern 320 surrounded by the plurality of embossed patterns 310 may be included. For example, the embossed pattern 310 may have an area greater than that of the engraved pattern 320. Since the embossed pattern 310 forms the innermost of the inner circumferential surface of the drum, it is likely to be in contact with the laundry. In some examples, the through hole may not be formed at a portion except the edge portion of the embossed pattern 310. On the other hand, since the engraved pattern 320 forms the outermost of the inner circumferential surface of the drum, the through hole may be formed in the engraved pattern 320. Particularly, the through hole may be formed at a center portion of the engraved pattern 320.

In detail, a plurality of octagonal patterns 310 formed to be embossed on the circumferential surface of the drum and a plurality of square patterns 320 surrounded by four of the plurality of octagonal patterns may be formed.

That is, four octagonal patterns 310 surrounding one square pattern 320 may be formed. The four octagonal patterns 310 may be formed to surround the square pattern 320 uniformly provided at the center.

In some implementations, the octagonal patterns 310 are formed to be embossed. For example, the octagonal patterns 310 may be embossed toward the inner side of the drum. Therefore, the four octagonal patterns 310 form a mountain surrounding one square pattern 310. The square pattern 310 forms a basin or valley surrounded by mountains. That is, the octagonal pattern provides an inclined surface toward the square pattern 310. Therefore, water flows along the inclined surface of the octagonal pattern and then is collected in the square pattern 310.

In some implementations, a main through hole 330 is formed in the square pattern 320. For example, the main through hole 330 for discharging water inside the drum 100 to the outside of the drum is formed. Water flowing from the octagonal patterns 310 surrounding the square pattern 320 is discharge to the outside of the drum through the main through hole 330.

In some examples, the main through hole 330 may be defined at the center of the square pattern 320. In these examples, water inflow paths may be symmetrical in a radial direction based on the main through hole 330. Therefore, the water may be discharged actively through the main through hole 330 without colliding with each other.

In some examples, the square pattern 320 may be engraved unlike the octagonal pattern 310. In these examples, the square pattern 320 may protrude toward the outside of the drum. Sections and position relation of the octagonal pattern 310, the square pattern 320 and the main through hole 330 will be described later.

As shown in FIGS. 4 and 5, the pattern group 300 may include a plurality of octagonal patterns 310, a plurality of square patterns 420 and a plurality of main through holes 330. As described later, the pattern group 300 may further include a sub through hole 350 formed between the octagonal pattern 310 and the square pattern 320.

In FIG. 4, one pattern group 300 has three octagonal patterns and two square patterns in a circumferential direction of the drum and has six octagonal patterns and five square patterns in a length direction of the drum.

Since most of laundry is located at the center portion in a length direction of the drum during washing and dehydration, the pattern group may be longitudinally arranged in a length direction of the drum. The pattern group may not be defined at either or both of front and rear ends.

In some implementations, the octagonal pattern 310 and the square pattern 320 may share any one side. For example, the octagonal pattern 310 and the square pattern 320 may substantially contact each other without being spaced apart from each other. An interval for identifying the octagonal pattern 310 from the square pattern 320 may be provided between the octagonal pattern 310 and the square pattern 320. This interval is a portion where the embossed pattern and the engraved pattern are not formed, and may be similar to the aforementioned dummy pattern portion.

That is, as shown in FIG. 4, the octagonal pattern and the square pattern may be formed to be in contact with each other or be spaced apart from each other at a certain level.

As described above, if the octagonal pattern 310 is formed to be embossed and the square pattern 320 is formed to be engraved, the embossed pattern and the engraved pattern may be formed based on one side shared by the octagonal pattern and the square pattern. That is, in one side, an inclined surface protruded toward the inside of the drum is formed toward the center of the octagonal pattern 310 and an inclined surface protruded toward the outside of the drum is formed toward the center of the square pattern 320.

Therefore, the octagonal pattern 310 and the square pattern 320 are continuously formed to be able to form the dense type pattern group 300. The inclined surface substantially continuous toward the center of the square pattern 320 from the center of the octagonal pattern 310 may be formed. That is, a big radius difference (substantially, altitude difference) may be formed at the center of the octagonal pattern 310 and the square pattern 320. Therefore, water may flow effectively and actively. In this case, water may actively and effectively enter the main through hole 330 and then may be discharged.

In a state that the octagonal pattern is not in contact with the square pattern, an inclination based on an embossed pattern of the octagonal pattern may be at one side based on a width of the interval and an inclination based on an engraved pattern of the square pattern may be formed at the other side.

In detail, one square pattern 320 has four sides 320*a*, 320*b*, 320*c* and 320*d*. Four octagonal patterns 310 are formed around one square pattern 320. For instance, the four octagonal patterns 310 may be formed symmetrically in up and down and left and right directions based on the square pattern 320.

Therefore, the side 320*a* may be shared with the octagonal pattern located on the square pattern 320. Likewise, the side 320*b* may be shared with the octagonal pattern located at the right side, the side 320*c* may be shared with the octagonal pattern located below the square pattern 320, and the side 320*d* may be shared with the octagonal pattern located at the left side of the square pattern 320.

One octagonal pattern 310 has eight sides 310*a* to 310*h*. Four sides 310*a*, 310*c*, 310*e* and 310*g* of the eight sides may respectively be shared with their adjacent four square patterns, and the other four sides 310*b*, 310*d*, 310*f* and 310*h* may respectively be shared with their adjacent four square patterns.

An inclination near the sides 310*a*, 310*c*, 310*e*, and 310*g* shared between the octagonal pattern and the square pattern is different from an inclination near the sides 310*b*, 310*d*, 310*f* and 310*h*. This is because that the octagonal pattern may be embossed, and the square pattern may be formed to be engraved.

In this case, although a continuous downward inclination may be formed at the side shared between the octagonal pattern and the square pattern, no inclination may be formed at the side shared between the octagonal pattern and the square pattern.

That is, if water is headed for the near square pattern along the octagonal pattern, the water may flow along the continuous downward inclination by passing through the side shared between the octagonal pattern and the square pattern. On the other hand, if the water is headed for the near octagonal pattern along the octagonal pattern and reaches the side shared between the octagonal pattern and the square pattern along the downward inclination, the water meets upward inclination. Stagnant water occurs at the side shared between the octagonal pattern and the octagonal pattern.

The side shared between the octagonal pattern and the octagonal pattern is not formed to be engraved or embossed. Therefore, the side shared between the octagonal pattern and the octagonal pattern may be a position where an inner circumferential radius and an outer circumferential radius of the drum are substantially defined. Therefore, no inclination is formed.

The water stagnant at the side shared between the octagonal pattern and the octagonal pattern may flow to the square pattern along the inner circumferential surface of the drum. However, at this time, since the path of the water is not downward inclination, a flow of the water is not relatively active. Therefore, the stagnant water may be generated or a long time may be required to discharge the water.

To reduce the stagnant water or actively discharge the water, a sub through hole 350 may be formed. For example, the sub through hole 350 is formed at the center of the portion where the octagonal pattern is in contact with another octagonal pattern. In detail, the sub through hole 350 may be defined at the center of a length direction of the side shared between the octagonal pattern and the octagonal pattern. Since the water may be discharged to the outside of the drum through the sub through hole 350 without being stagnant, it may be more effective.

As shown in FIGS. 4 and 5, the octagonal pattern 310 may be formed in a regular octagonal shape, and the square pattern 320 may be formed in a square shape. Since the octagonal pattern and the square pattern share one side, four octagonal patterns may be formed to surround one square pattern.

Therefore, an area of the octagonal pattern is greater than that of the square pattern. Like the difference in areas, a length from the center of each pattern to the center of one side may be different. Therefore, when each pattern is embossed or engraved, a protrusion length or a recess length may be longer at a wide area pattern. In other words, forming process may be performed more easily. If the protrusion length is more increased at a small area, problems occur in that a necessary force may be more increased, and the plate may be torn.

In some implementations, the protrusion or recess length of the octagonal pattern is longer than that of the square pattern. In addition, there may be limitation in increasing the protrusion length toward the outside of the drum as compared with the radius of the substantial outer circumferential surface of the drum. This is because that the drum may interfere with the tub provided at the outside of the drum. Therefore, the protrusion length of the octagonal pattern is allowed to be longer than the protrusion length of the square pattern, whereby an inclined surface length from the center of the octagonal pattern to the center of the square pattern may be more increased.

The type that the octagonal pattern is in contact with the octagonal pattern and the type that the octagonal pattern is in contact with the square pattern have been described as above. However, as described above, the octagonal pattern and the square pattern may be formed to be spaced apart from each other. Likewise, the octagonal pattern and another octagonal pattern may be formed to be spaced apart from each other.

Figure 6:
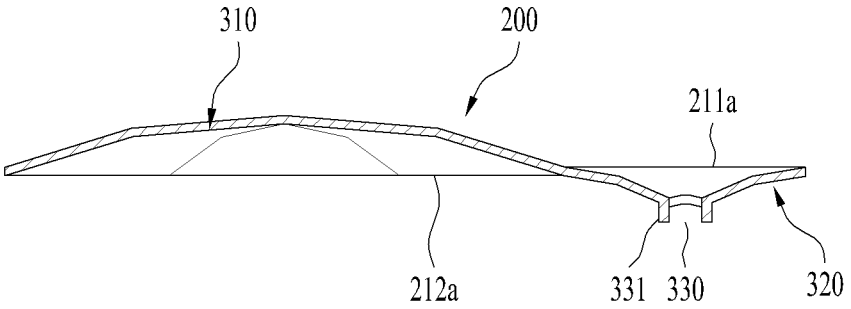
FIG. 6 is a cross-sectional view between a center of an example octagonal pattern and an example square pattern in an example pattern group shown in FIG. 4.

Hereinafter, sectional structures of the embossed pattern and the engraved pattern will be described in detail with reference to FIG. 6. For example, the sectional structure of the octagonal pattern which is the embossed pattern with a wide area and the sectional structure of the square pattern which is the engraved pattern with a small area will be described in detail. As described later, shapes of the octagonal pattern and the square pattern may be varied depending on implementations.

The drum may be formed through a thin plate. Therefore, the drum may have a thickness of 0.5 mm, approximately.

Based on the thickness, an inner surface of the plate forms the inner circumferential surface 211*a* of the drum and an outer surface of the plate forms the outer circumferential surface 212*a*. A radius of the inner circumferential surface is greater than that of the outer circumferential surface by reflecting the thickness.

After the embossed and engraved patterns are formed on the plate and then bent, the drum may be formed. Therefore, the inner circumferential radius and the outer circumferential radius at the embossed portion become greater than the inner circumferential radius and the outer circumferential radius at the engraved portion. Substantially, the portion where the embossed and engraved patterns are not formed forms a reference outer circumferential radius and a reference inner circumferential radius of the drum. That is, according to the aforementioned implementation, the reference radius of the drum is formed at the side where the octagonal pattern is in contact with another octagonal pattern and the side where the square pattern is in contact with the octagonal pattern.

A height or protrusion length at the center of the octagonal pattern 310 is the greatest and downwardly inclined toward the outside. That is, the octagonal pattern 310 has an inclined surface. The inclination may be formed by any one of a straight line, a curved line and a combination of the straight line and the curved line. In some examples, this inclination may be continuously formed.

A depth or recess length at the center of the square pattern 320 is the greatest and upwardly inclined toward the outside. That is, the square pattern 320 has an inclined surface. Likewise, the inclination may be formed by any one of a straight line, a curved line and a combination of the straight line and the curved line. Likewise, in some examples, this inclination may be continuously formed.

Therefore, a continuous downward inclination may be formed from the center of the octagonal pattern 310 to the center of the square pattern 320. Therefore, water located on the octagonal pattern 310 may actively enter the center of the square pattern along the inclined surface.

As described above, the main through hole 330 may be formed by piercing. For example, the main through hole 330 may not be formed by only formation of a through hole by cutting. For example, if a hole having a small radius is formed through punching or piercing, a portion of the plate may be cut to form the hole. Afterwards, if an awl type tool of which radius is gradually increased is inserted into the hole, the radius of the hole may be enlarged. At this time, a burr may be formed around the hole. The burr may be formed to be more protruded toward the outside of the drum.

The burr may have a protrusion length greater than a thickness of the drum. Therefore, a thin pipe surrounding the main through hole 330 may be formed at the drum outside of the main through hole 330. The pipe may have a thickness of 0.6 mm greater than the thickness of the drum if the drum has a thickness of 0.5 mm.

In some cases, the burr may be removed through a deburring process. However, in this implementation, the burr may be maintained without being removed. This is because that the laundry may be prevented from being remarkably taken out of the drum through the through hole. Therefore, a part of the laundry may be prevented from being taken out of the through hole may be caught in the burr and may be prevented from being damaged when the laundry is taken out of the drum.

The pipe by the burr may be referred to as a capillary tube. That is, the pipe may perform a function as a pipe having a very small radius. A capillary phenomenon may occur such that a water level inside the capillary tube is higher than that near the capillary tube as a diameter of the capillary tube becomes small. Therefore, the diameter of the capillary tube becomes smaller and its length becomes longer, whereby the capillary phenomenon may be more expedited.

The pipe 331 surrounding the through hole may be formed in such a manner that a separate pipe not the burr is provided near the main through hole. Water discharge may be performed more effectively by the capillary phenomenon. That is, the water stagnant in the drum may more effectively be discharge through the capillary tube type pipe 331.

Figure 7:
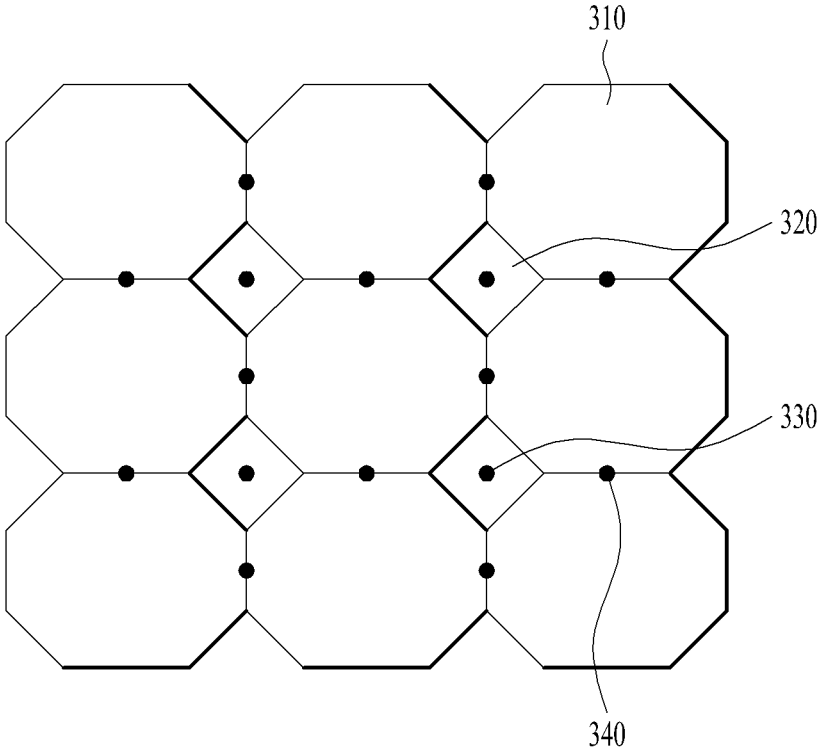
FIG. 7 is a brief view illustrating an example group pattern defined in an example drum.

FIG. 7 illustrates a pattern different from the aforementioned patterns. Unlike the aforementioned octagonal pattern, the octagonal pattern in this implementation may be not the regular octagonal pattern. That is, among the sides of the octagonal pattern, lengths of the sides shared with the square pattern may be different from lengths of the sides which are not shared with the square pattern. The octagonal pattern may be formed in a shape long in a left and right direction or a shape long in an up and down direction. Even in this case, one square pattern is surrounded by four octagonal patterns.

It may be assumed that the pattern shown in FIG. 7 is rolled in a left and right direction to form a drum. That is, it may be assumed that the square pattern is bent in a left and right direction in a state that the square pattern is arranged in a diamond shape. In FIG. 5, two of four sides of the square pattern are parallel with the center shaft of the drum and the other two are vertical to the center shaft of the drum. On the other hand, FIG. 7 illustrates that four sides of the square pattern are all oblique with the center shaft of the drum at the same angle. That is, rotation of 45° in FIG. 5 is similar to the type shown in FIG. 7. However, the type of FIG. 5 may be different from that of FIG. 7 in the octagonal pattern.

Therefore, according to this implementation, the octagonal pattern may not be a regular octagonal pattern. In some examples, an angle of the octagonal pattern and the square pattern with the center shaft of the drum may be varied.

If the plate is bent to form the drum, the angle between the pattern group 300 and the center shaft of the drum may be important. That is, resistance of the plate with respect to force or deformation required for bending may be varied depending on the angle between the pattern group 300 and the center shaft of the drum. This is because the pattern group 300 may be embossed and/or engraved. That is, resistance for deformation at the portion protruded toward the inner side of the reference radius and the portion protruded toward the outer side of the reference radius is greater if the drum is bent to have a reference radius.

Referring to the octagonal pattern shown in FIG. 7, an upper side and a lower side are arranged vertically to the center shaft of the drum. The upper side and the lower side are shared by two octagonal patterns. Therefore, the upper side and the lower side may be a valley type where a rapid inclination change is formed. In this valley type, greater bending resistance occurs.

For this reason, in some cases, the octagonal pattern may not be a type extending long in a left and right direction. This is because that the length of the side vertical to the center shaft of the drum becomes longer than the length of the side parallel with the center shaft of the drum. In some examples, the octagonal pattern is long in an up and down direction. For example, the patterns shown in FIG. 7 may be rotated at 90°. Of course, in some examples, the octagonal pattern shown in FIG. 7 may be formed in a regular octagonal pattern.

In case of the regular octagonal pattern shown in FIG. 5, the side parallel with the center shaft of the drum has the same length as that of the side vertical to the center shaft of the drum. Therefore, bending resistance in the regular octagonal patterns according to a rotation angle of the pattern group 300 may not be varied greatly.

In the square shape shown in FIG. 5, the length of the square shape vertical to the center shaft of the drum may be A which is a length of one side of the square shape. However, in the square shape shown in FIG. 7, the length of the square shape vertical to the center shaft of the drum is a value obtained by multiplying A by a square root of 2. Therefore, a bending resistance length is more increased.

In some examples, two sides of the square pattern are located to be vertical to the center shaft of the drum. In other words, the other two sides of the square pattern are located to be parallel with the center shaft of the drum. Therefore, in view of bending resistance, the pattern group may be formed in the shape shown in FIG. 5. The drum may be easily manufactured through arrangement type, arrangement position, and arrangement angle of the pattern group. For example, if the drum is manufactured by bending in a circle shape, the drum having desired roundness may be manufactured.

In some implementations, the pattern group may be formed on the bottom as well as the circumferential surface of the drum. This is because that water may be discharged to the outside of the drum through the bottom as well as the circumferential surface of the drum during drainage or dehydration.

An experimental result of dehydration effect is as follows.

In case of the drum of the related art provided by this applicant, that is, the type that the through hole is formed on the inner circumferential surface of the drum, it is noted that a remaining moisture content (RMC) is 46.87%, approximately. In the type that the octagonal pattern and the square pattern are formed and the through hole is formed in the square pattern, that is, in the pattern having four through holes, it is noted that RMC is 43.50%, approximately. Therefore, it is noted that the RMC may be reduced through the pattern according to one implementation of the present disclosure.

Also, in the type that the octagonal pattern and the square pattern are formed, four through holes are formed in the square pattern and two through holes are formed between the octagonal patterns, that is, six through holes are formed, it is noted that the RMC is 43.16%, approximately. Therefore, it is noted that the RMC may be more reduced by reducing water stagnant between the octagonal patterns.

This experimental result represents that the RMC may be more reduced in the type that eight through holes are formed.

According to one implementation of the present disclosure, dehydrating effect may simply be enhanced, and damage of the laundry may be reduced remarkably.

The laundry is adhered to the drum and tends to be strained during dehydration. Therefore, the octagonal pattern which is a high mountain shape on every side based on the main through hole. Therefore, the laundry is supported and strained at the center of the octagonal pattern and the center of its octagonal pattern. Therefore, a sagging length of the laundry based on the center of the square pattern may be reduced remarkably. Since an altitude difference (substantially, radius difference) between the centers of the octagonal pattern and the square pattern becomes greater, the laundry may be more prevented from being inserted into the main through hole.

For this reason, according to one implementation of the present disclosure, dehydrating effect may be enhanced, and damage of the laundry may be reduced remarkably.

One implementation of the present disclosure may comprise a drum of a washing machine and a washing machine comprising the drum.

Figure 8:
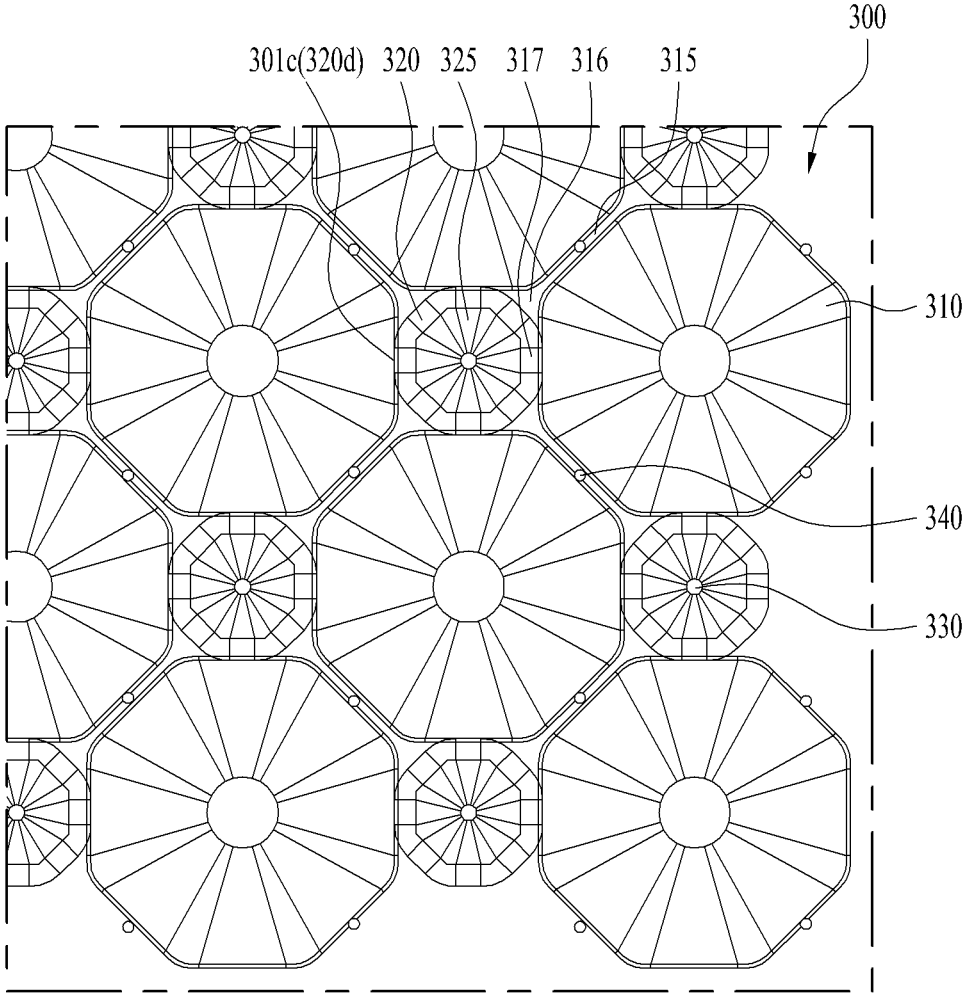
FIG. 8 is a brief view illustrating an example group pattern defined in an example drum.

Hereinafter, another implementation of the group pattern will be described with reference to FIG. 8. Since basics are the same as those of the previous implementations, description will be given based on a difference from the previous implementations. Only a portion of the difference may be different from the aforementioned implementations.

In this implementation, the octagonal pattern and another octagonal pattern may not share one side. That is, the octagonal pattern may be spaced apart from another octagonal pattern at a certain interval. Therefore, facing sides may be parallel with each other. Therefore, a water moving path having a width wider than that of the aforementioned implementation may be formed. That is, a horizontal portion 315 may be formed between two octagonal patterns, whereby the water moving path may be formed.

The horizontal portion 315 may be a portion where the engraved or embossed pattern is excluded. Therefore, an inner reference radius of the drum and an outer reference radius of the drum may be formed as a horizontal plane.

The horizontal portion 315 may be provided with a sub through hole 340. The sub through hole 340 may be formed at the center of a length direction of the horizontal portion. A size of the sub through hole 340 may be smaller than that of the main through hole 330.

Piercing for forming a through hole may be performed after engraved and embossed patterns are formed. If piercing is performed after the engraved and embossed patterns are formed, for example, a minimum horizontal area may be obtained at the portion where the through hole is formed. Therefore, the horizontal area for piercing may be obtained through the horizontal portion 315. Since an interval between the embossed patterns is obtained, molding is easily performed.

The horizontal portion 315 may have directionality. In an example of FIG. 8, the horizontal portion is formed at four sides of one octagonal pattern. For example, sides located at quadrants 1 and 3 of the octagonal pattern may be adhered to each other and sides located at quadrants 2 and 4 may be spaced apart from each other, or vice versa.

In this implementation, an inner pattern may be formed inside the square pattern 320. That is, the inner pattern 325 smaller than the square pattern 320 may be formed. The inner pattern 325 may be engraved. For example, a circle type engraved pattern or a polygonal type engraved pattern may be formed. In the example shown in FIG. 8, the inner pattern is engraved in an octagonal pattern. In some examples, the polygonal type may have angles of a square or more.

The inner pattern 325 may be formed toward the inner side of a radius direction from the outside of the square pattern 320. The main through hole 330 may be formed at the center of the inner pattern 325.

A horizontal portion 317 having a certain interval may be formed between the outside or edge of the square pattern and the outside or edge of the inner pattern. The horizontal portion 317 may not be engraved or embossed.

Since an interval may be given between molding for forming the octagonal pattern and molding for forming the engraved pattern through the horizontal portion 317, molding is easily performed.

A horizontal portion 316 of a wider area may be formed at corner portions inside the square pattern. For this reason, water flowing from the horizontal portion 315 may enter the square pattern more actively. Since water enters the square pattern through four horizontal portions 315 based on one main through hole, the size of the main through hole may be greater than that of the sub through hole formed in the horizontal portion 315.

In this implementation, corners of the octagonal pattern may be formed in a round type not an angulated type. Therefore, the corners of the octagonal pattern may be opened types not the type that two sides do not meet. Molding may easily be performed through the round type.

Figure 9:
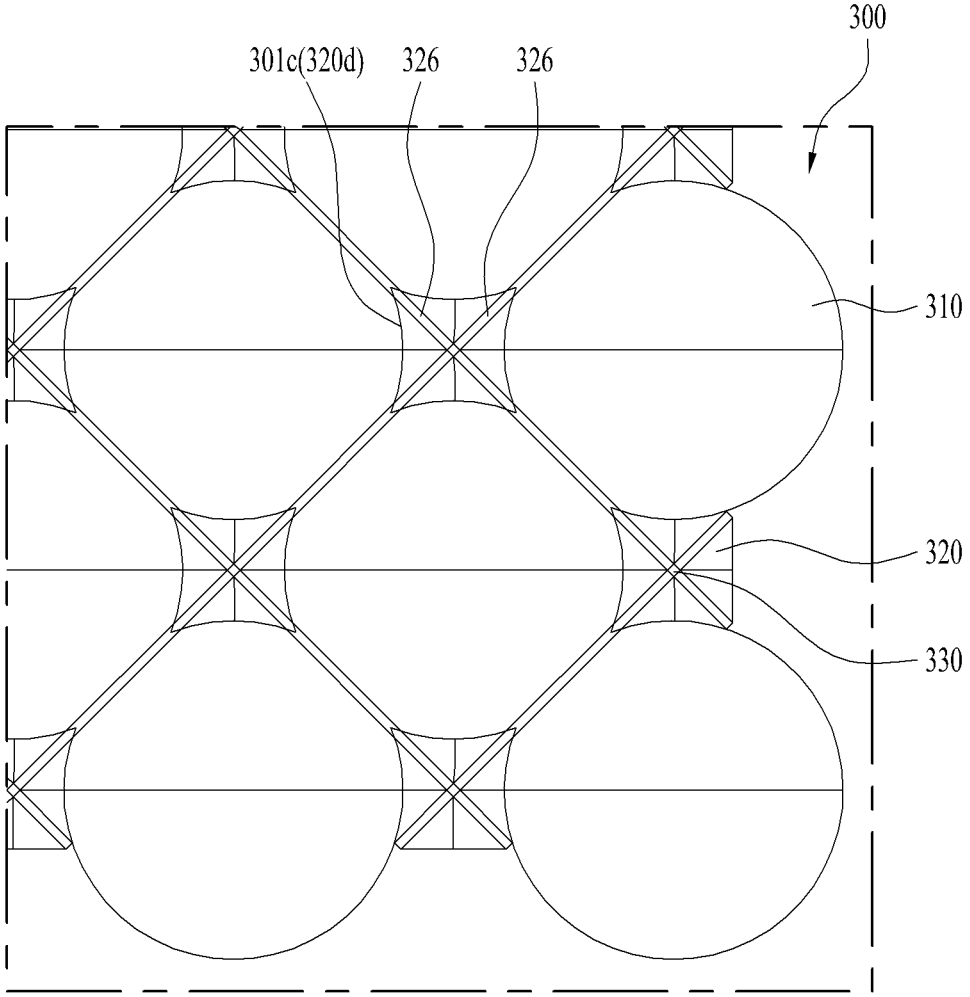
FIG. 9 is a brief view illustrating an example group pattern defined in an example drum.

Hereinafter, still another implementation of the group pattern will be described with reference to FIG. 9.

Since basics are the same as those of the previous implementations, description will be given based on a difference from the previous implementations. Only a portion of the difference may be different from the aforementioned implementations.

In this implementation, some sides of the octagonal pattern may be formed in such a manner that curves not a straight line or two straight lines cross each other at an obtuse angle. Particularly, a side at a portion which is in contact with the square pattern may be formed in this type. If any one side 301*c* of the octagonal pattern is a curved type, any one side 320*d* of the square pattern corresponding to the octagonal pattern may be a curved type. Therefore, in this case, four sides of the square pattern may be formed to be recessed toward the center.

A diagonal type engraved pattern instead of a circle or polygonal type engraved pattern may substantially be formed inside the square pattern 320. That is, the engraved pattern may be formed in two diagonal types for connecting two facing corners with each other. This diagonal type engraved pattern may be formed to have the longest protrusion length at the center of the square pattern.

Since the water entering the square pattern is collected in a diagonal type water way or path and flows toward the center, more active type water path may be formed.

Figure 10:
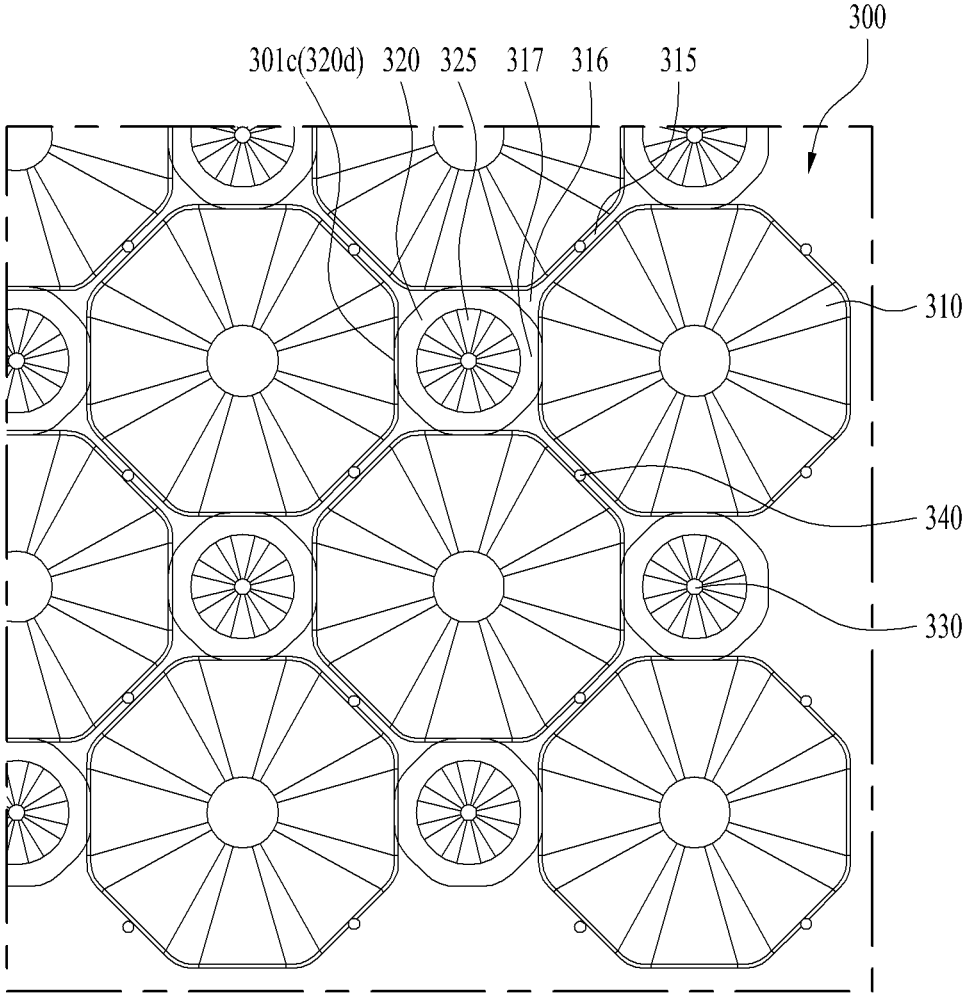
FIG. 10 is a brief view illustrating an example group pattern defined in an example drum.

Hereinafter, further still another implementation of the group pattern will be described with reference to FIG. 10.

Since basics are the same as those of the previous implementations, description will be given based on a difference from the previous implementations. Only a portion of the difference may be different from the aforementioned implementations.

In this implementation, a dome type engraved pattern 325, that is, an inner pattern 325 may be formed inside the square pattern 320. That is, an inner pattern having an edge portion of a circle, recessed to be rounded toward the center may be formed. The main through hole 330 may be formed at the center of the inner pattern.

Even in this implementation, a spaced distance may be formed between the edge of the square pattern and the edge of the inner pattern. The spaced distance may form a horizontal portion 317.

Figure 11:
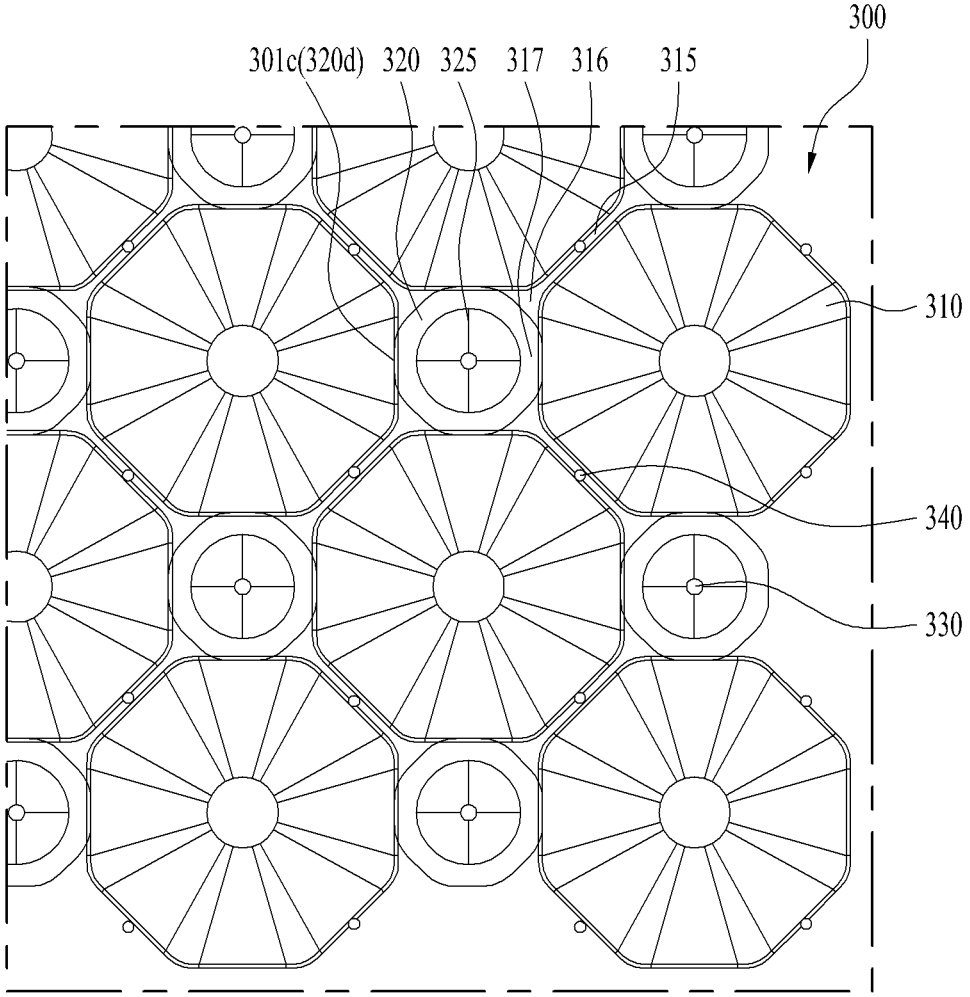
FIG. 11 is a brief view illustrating an example group pattern defined in an example drum.

Hereinafter, further still another implementation of the group pattern will be described with reference to FIG. 11.

Since basics are the same as those of the previous implementations, description will be given based on a difference from the previous implementations. Only a portion of the difference may be different from the aforementioned implementations.

In this implementation, a cone type engraved pattern, that is, an inner pattern 325 may be formed inside the square pattern 320. That is, an inner pattern having an edge portion of a circle, recessed toward the center may be formed. The main through hole may be formed at the center of the inner pattern.

The cone type engraved pattern may be inclined toward the center, and its center portion may be formed to have a plane. That is, the engraved pattern may have a ladder type cone or cylindrical shape of which radius becomes smaller as a height is increased. Of course, the main through hole 330 may be formed at the center of the engraved pattern.

Even in this implementation, a spaced distance may be formed between the edge of the square pattern and the edge of the inner pattern. The spaced distance may form a horizontal portion 317.

Since the inner pattern which is engraved has a cone or cylindrical shape and a horizontal portion is formed near the outside of the inner pattern, the group pattern is easily formed.

Figure 12:
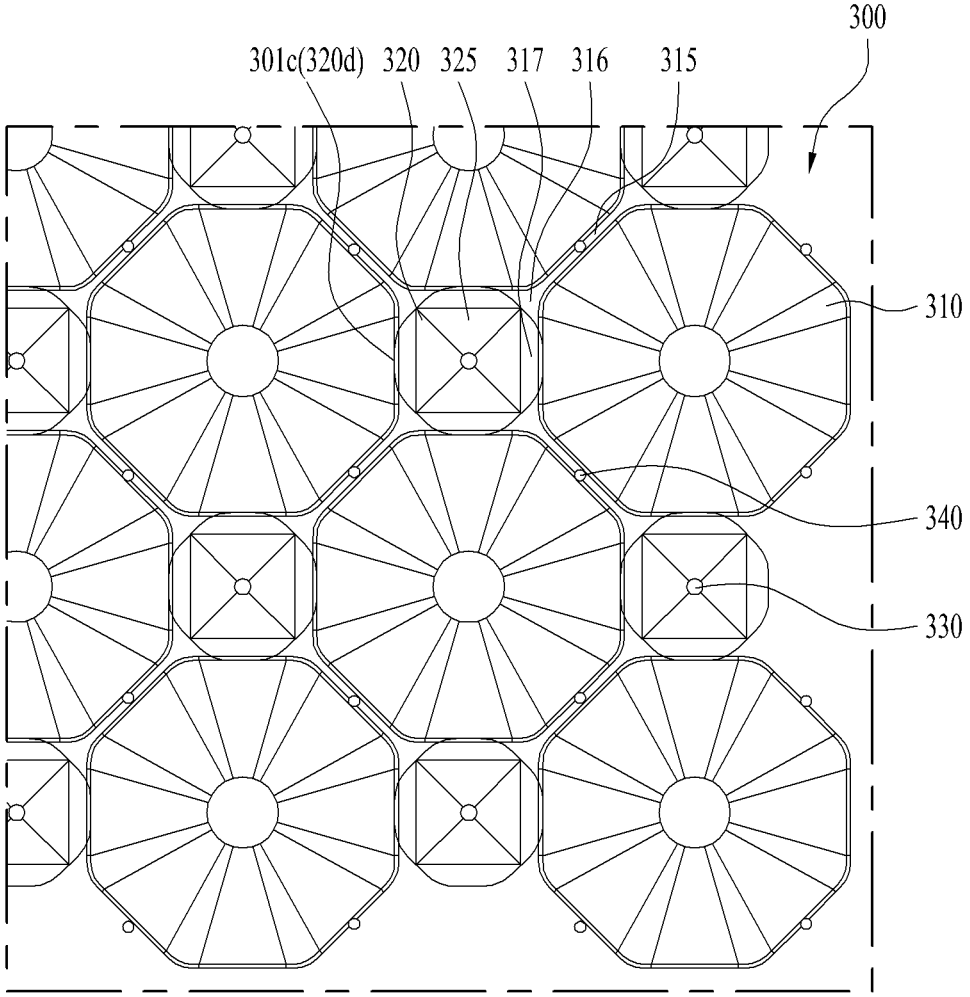
FIG. 12 is a brief view illustrating an example group pattern defined in an example drum.

Hereinafter, further still another implementation of the group pattern will be described with reference to FIG. 12.

Since basics are the same as those of the previous implementations, description will be given based on a difference from the previous implementations. Only a portion of the difference may be different from the aforementioned implementations.

In this implementation, a quadrangular pyramid type engraved pattern, that is, an inner pattern 325 may be formed inside the square pattern 320. That is, an inner pattern having an edge portion of a quadrangle, recessed toward the center may be formed. The main through hole 330 may be formed at the center of the inner pattern.

The quadrangular pyramid type engraved pattern may be inclined toward the center, and its center portion may be formed to have a plane. That is, the engraved pattern may have a ladder type quadrangular pyramid or quadrangular pillar shape of which recessed area becomes smaller as a height is increased. Of course, the main through hole may be formed at the center of the engraved pattern.

Even in this implementation, a spaced distance may be formed between the edge of the square pattern and the edge of the inner pattern. The spaced distance may form a horizontal portion.

Since the inner pattern which is engraved has a quadrangular pyramid or quadrangular pillar shape and a horizontal portion is formed near the outside of the inner pattern, the group pattern is easily formed.

The group patterns having the octagonal pattern and the square pattern have been described as above.

The features described in the respective implementations may be applied to another implementation unless contradicted or exclusive.

In the aforementioned implementations, the inner pattern may be formed to be engraved, and the edge portion of the inner pattern which is engraved may have a circle or polygonal shape. Various modifications may be made in the recessed shape, and their examples may include a dome shape, a cone shape, and a ladder shape. The main through hole may be formed at the center of the inner pattern, and an inclined surface may be formed around the main through hole. Of course, a horizontal surface may be formed.

Therefore, a recessed length may be the longest at the main through hole portion in any case.

Figure 13:
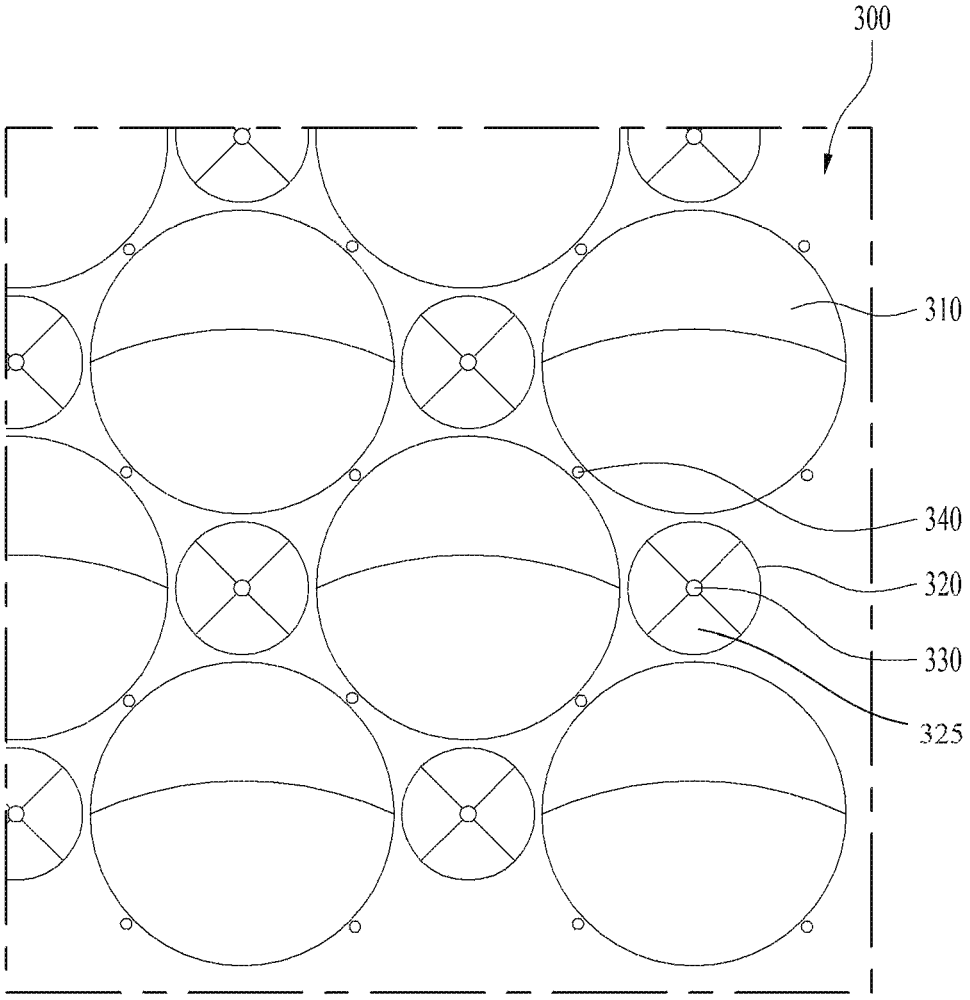
FIG. 13 is a brief view illustrating an example group pattern defined in an example.

Hereinafter, further still another implementation of the group pattern will be described with reference to FIG. 13.

Since basics are the same as those of the previous implementations, description will be given based on a difference from the previous implementations. Only a portion of the difference may be different from the aforementioned implementations.

In this implementation, an engraved pattern 320 has a circle shape, and a cone type inner pattern 325 may be formed inside the engraved pattern. The engraved pattern 320 may be the inner pattern. A through hole may be formed at the end of the inner pattern 325, that is, a horn portion. The inclined surface may be formed toward the through hole by the cone type engraved pattern.

In this implementation, the embossed pattern 310 may be formed in a circle. The embossed pattern is formed in a dome shape, and its center portion forms the innermost portion of the inner surface of the drum.

The engraved pattern is surrounded by the embossed patterns, and a predetermined spaced distance is formed between the edge of the embossed pattern and the edge of the engraved pattern. For example, the through hole 340 may be formed at the spaced distance portion. That is, water flowing between the embossed patterns may be discharged to the through hole 340. Water flowing to the engraved pattern may be discharged through the through hole 330 formed at the center of the engraved pattern.

Therefore, a path through which water may flow is specified through the embossed patterns and the engraved patterns. Since through holes are formed on the specified path, occurrence of stagnant water may be reduced remarkably. Particularly, water flows to the outside of the dome shape along the embossed pattern of the dome shape. The water is collected in a space between the embossed patterns. As shown, the water collected in the space between the embossed patterns has no option but to be discharged to four through holes 340 or the through hole 330 of the engraved pattern. Therefore, stagnant water may be minimized to actively perform dehydration.

The features described in the respective implementations may be applied to another implementation unless contradicted or exclusive.

In the aforementioned implementations, the inner pattern may be formed to be engraved, and the edge portion of the inner pattern which is engraved may have a circle or polygonal shape. Various modifications may be made in the recessed shape, and their examples may include a dome shape, a cone shape, and a ladder shape. The main through hole may be formed at the center of the inner pattern, and an inclined surface may be formed around the main through hole. Of course, a horizontal surface may be formed.

Therefore, a recessed length may be the longest at the main through hole portion in any case.

Figure 14:
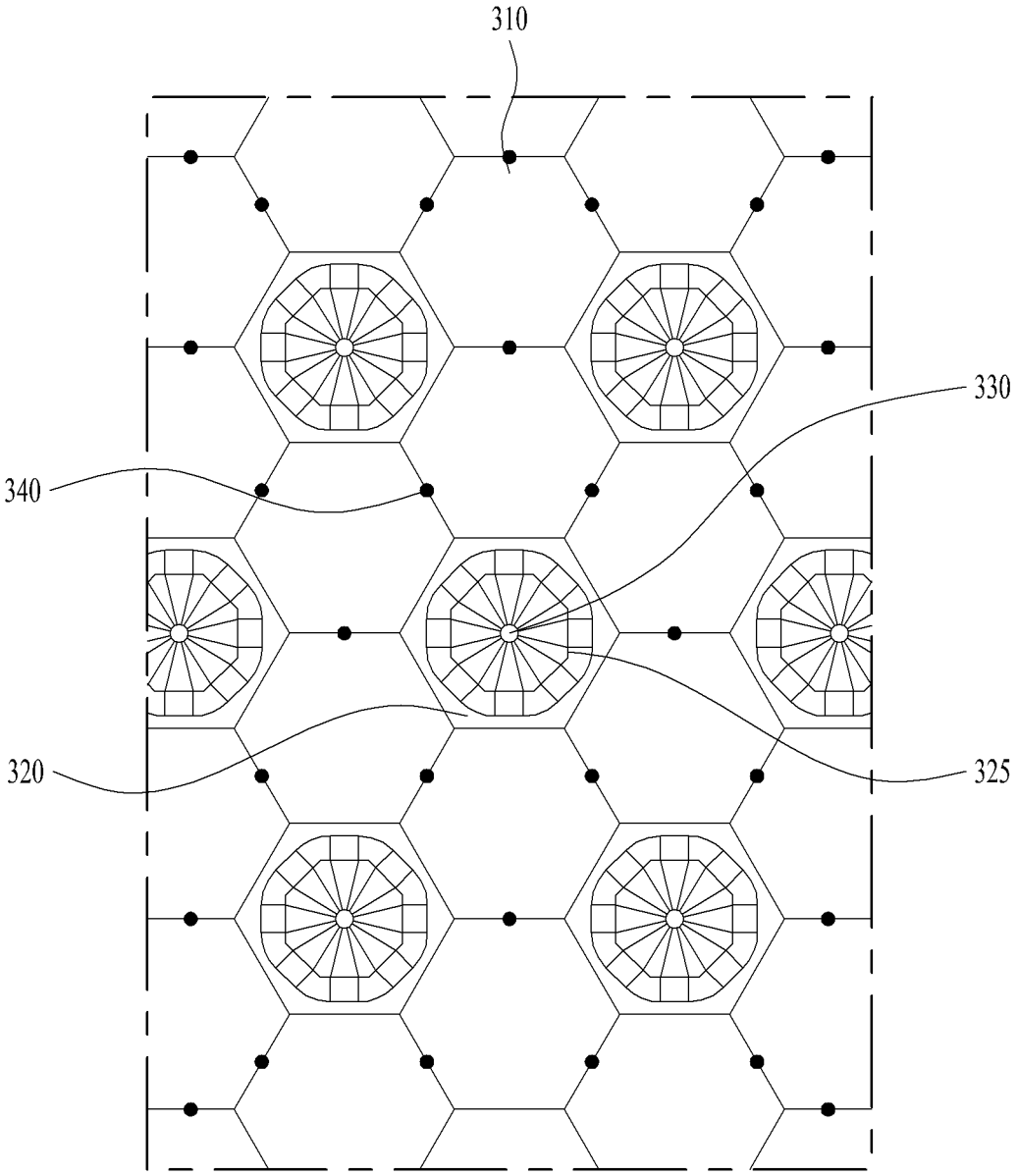
FIG. 14 is a brief view illustrating an example embossed pattern replaced with another example pattern.

Hereinafter, further still another implementation of the group pattern will be described with reference to FIG. 14.

In the aforementioned implementations, the square pattern surrounded by the octagonal patterns have been described. However, the pattern surrounded by various patterns such as circle patterns or hexagonal patterns not the octagonal patterns may be formed. The pattern surrounded by various patterns may have various shapes not the square pattern.

Therefore, considering the aforementioned implementations and this implementation, a group pattern having a plurality of outer side patterns 310 and an inner pattern 325 surrounded by the plurality of outer side patterns may be provided.

For example, four octagonal patterns may be referred to as outer side patterns, and one pattern surrounded by these outer side patterns may be referred to as an inner pattern. Also, six hexagonal patterns may be referred to as outer side patterns, and one pattern surrounded by these outer side patterns may be referred to as an inner pattern. An edge shape of the inner pattern may be formed in various shapes.

Also, the edge shape and the recessed shape of the inner pattern 325 formed inside the inner side pattern 320 may be formed in various shapes. The edge shape and the recessed shape of the inner pattern in the aforementioned implementations.

In other words, a drum comprising a group pattern having a plurality of outer side patterns 310 formed to be embossed and one inner pattern 325 formed to be engraved may be provided. Combination of the outer side patterns and the inner pattern may be formed repeatedly.

In some implementations, a size (i.e., an area of the outer side pattern) is greater than a size (i.e., area of the inner pattern). Therefore, water may easily move to the inner pattern through the outer side patterns, and then may easily be discharged to the outside of the drum through the outer side patterns. This structure and effect may be the same as those described with reference to FIG. 6.

Also, the edge, that is, one side of the outer side patterns may be the same as the edge, that is, one side of the inner pattern. Of course, the outer side patterns may be spaced apart from the inner pattern. If the outer side patterns are spaced apart from the inner pattern, a horizontal portion may be formed as much as the spaced distance. A sub through hole may be formed in the horizontal portion.

Various modifications may be made in the shapes of the outer side patterns and the inner pattern. For example, the area of the outer side patterns formed to be embossed is greater than that of the inner pattern formed to be engraved. In some examples, the through hole is formed at a portion where the outer side patterns face each other, and that the through hole is also formed at the center of the inner pattern.

Hereinafter, the implementations of the present disclosure are listed as follows.

1. A drum of a washing machine in which laundry is received to perform washing or dehydration, the drum comprising:

a plurality of octagonal patterns formed to be embossed on a circumferential surface of the drum;

a square pattern formed on the circumferential surface of the drum and surrounded by four of the plurality of octagonal patterns; and a main through hole formed in the square pattern.

2. The drum of a washing machine according to the first implementation, wherein the octagonal pattern is formed in a regular octagonal shape, and the square pattern is formed in a square shape.

3. The drum of a washing machine according to the second implementation, wherein four sides of the square pattern are formed through the four octagonal patterns surrounding the square pattern.

4. The drum of a washing machine according to the first implementation, wherein the octagonal pattern is formed to be embossed toward an inner side of the drum, and the square pattern is formed to be engraved toward an outer side of the drum.

5. The drum of a washing machine according to any one of the first to fourth implementations, wherein the octagonal pattern has an area greater than that of the square pattern, and its protrusion length is longer than that of the square pattern.

6. The drum of a washing machine according to the fourth implementation, wherein the side of the octagonal pattern and the side of the square pattern form a reference surface of the drum, and the octagonal pattern is formed to be embossed on the reference surface, and the square pattern is formed to be engraved on the reference surface.

7. The drum of a washing machine according to the sixth implementation, wherein the octagonal pattern is formed to have a protrusion length which is the longest at the center.

8. The drum of a washing machine according to the seventh implementation, wherein the octagonal pattern is inclined to have a straight line, a curved line or combination of the straight line and the curved line from one side of the octagonal pattern to the center of the octagonal pattern.

9. The drum of a washing machine according to the fourth implementation, wherein any one of the four octagonal patterns surrounding the square pattern share one side with two adjacent octagonal patterns.

10. The drum of a washing machine according to the ninth implementation, wherein a sub through hole is formed at the side shared by the two octagonal patterns.

11. The drum of a washing machine according to the fourth implementation, wherein the square pattern is formed to have a protrusion length which is the longest at the center.

12. The drum of a washing machine according to the eleventh implementation, wherein the square pattern is inclined to have a straight line, a curved line or combination of the straight line and the curved line from one side of the square pattern to the center of the octagonal pattern.

13. The drum of a washing machine according to the eleventh implementation, wherein the main through hole is formed at the center of the square pattern.

14. The drum of a washing machine according to the thirteenth implementation, wherein a through hole extension portion surrounding the main through hole is formed on an outer circumferential surface of the drum, and a length of the through hole is more increased than a thickness of the circumferential surface of the drum by the through hole extension portion.

15. The drum of a washing machine according to any one of the first to fourth implementations, wherein the square pattern, the octagonal pattern and the main through hole are continuously formed in a plural number along a circumferential direction and a length direction of the drum to form a pattern group.

16. The drum of a washing machine according to the fifteenth implementation, wherein the pattern group is formed in a plural number along the circumferential direction of the drum, and a dummy pattern group from which the pattern group formation is excluded is formed between the pattern group and the pattern group.

17. The drum of a washing machine according to the sixteenth implementation, wherein the pattern group formation is excluded at both ends of the length direction of the drum.

18. The drum of a washing machine according to the sixteenth implementation, wherein the dummy pattern group is provided with a plurality of dummy through holes.

19. The drum of a washing machine according to the fifteenth implementation, wherein the drum is formed by coupling both ends by rolling a metal plate provided with a plurality of pattern groups.

20. The drum of a washing machine according to the nineteenth implementation, wherein two sides of the square pattern are orthogonal to a rotary shaft of the drum and the other two sides are parallel with the rotary shaft of the drum.

21. The drum of a washing machine according to the first implementation, wherein an inner pattern of an engraved pattern protruded toward the outside of the drum is formed in a circle or polygonal shape.

22. The drum of a washing machine according to the twenty-first implementation, wherein the main through hole is formed at the center of the engraved pattern of a circle or polygonal shape.

23. The drum of a washing machine according to the twenty-first implementation, wherein the engraved pattern of a circle or polygonal shape has a protrusion length which is the longest at the center.

24. The drum of a washing machine according to the twenty-first implementation, wherein an edge of the inner pattern is formed at an inner side of an edge of the square pattern, and a horizontal portion from which engraved and embossed patterns are excluded is formed between the edge of the square pattern and the edge of the inner pattern.

25. The drum of a washing machine according to the first implementation, wherein at least any one of eight sides of the octagonal pattern is formed in a curved type or a type of two straight lines crossing at an obtuse angle.

26. The drum of a washing machine according to the twenty-fifth implementation, wherein the side of the curved type or the side of the type of two straight lines forms any one side of the square pattern adjacent to the octagonal pattern.

27. The drum of a washing machine according to the first implementation, wherein a horizontal portion from which engraved and embossed patterns are excluded is formed between the octagonal pattern and another octagonal pattern.

28. The drum of a washing machine according to the twenty-seventh implementation, wherein a sub through hole is formed in the horizontal portion.

29. The drum of a washing machine according to the first implementation, wherein a diagonal type engraved pattern of which protrusion length is the longest at the center is formed inside the square pattern.

30. The drum of a washing machine according to the twenty-ninth implementation, wherein the main through hole is formed at the center of the square pattern, and its size is greater than that of the sub through hole formed at a portion where the octagonal pattern is adjacent to another octagonal pattern.

It will be apparent to those skilled in the art that the present disclosure may be embodied in other specific forms without departing from the spirit and essential characteristics of the disclosure. Thus, the above implementations are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A drum of a washing machine configured to receive laundry and to perform washing or dehydration, the drum comprising:

a circumferential surface that includes:

a plurality of outer side patterns that protrude from the circumferential surface toward an interior of the drum, each of the plurality of outer side patterns having a first circle shape, an inner side pattern that is recessed from the circumferential surface toward an exterior of the drum and that is surrounded by the plurality of outer side patterns, an inner pattern that is engraved in the circumferential surface and that is defined inside of the inner side pattern, a through hole defined at a center of the inner side pattern inside of the inner side pattern, and a sub through hole defined at a space between two outer side patterns of the plurality of outer side patterns that face each other, wherein the plurality of outer side patterns are arranged about the inner side pattern and spaced apart from one another, and wherein an area of the inner pattern is less than an area defined by an edge region of the inner side pattern.

2. The drum according to claim 1, wherein an area of the plurality of outer side patterns is greater than the area of the inner side pattern.

3. The drum according to claim 1, wherein a protrusion length of each of the plurality of outer side patterns toward the interior of the drum is greater than a protrusion length of the inner side pattern toward the exterior of the drum.

4. The drum according to claim 1, wherein the through hole is defined at an inner end of the inner pattern that is disposed at the center of the inner side pattern.

5. The drum according to claim 4, wherein the through hole extends from the circumferential surface toward the exterior of the drum to an outermost position of the inner side pattern by a protrusion length.

6. The drum according to claim 1, wherein an edge of the inner side pattern has a circular or polygonal shape.

7. The drum according to claim 6, wherein the inner pattern defines a cone shape or a ladder shape that is recessed from the circumferential surface toward the exterior of the drum.

8. The drum according to claim 1, wherein the inner side pattern is spaced apart from the plurality of outer side patterns, the inner side pattern having a second circle shape that is different from the first circle shape, and wherein the inner pattern extends from a circumference of the inner side pattern to the through hole at the center of the inner side pattern.

9. The drum according to claim 1, wherein the inner pattern comprises a plurality of lines that extend radially from a circumference of the inner side pattern to the through hole.

10. The drum according to claim 1, wherein the inner pattern defines a cone shape extending from a circumference of the inner side pattern to the through hole at the center of the inner side pattern.

11. The drum according to claim 1, wherein the inner pattern comprises a plurality of inner patterns that are arranged about the center of the inner side pattern.

12. The drum according to claim 1, wherein the inner side pattern is spaced apart from the plurality of outer side patterns.

13. The drum according to claim 1, wherein the inner side pattern defines an outer end of the inner pattern, and the through hole defines an inner end of the inner pattern.

14. The drum according to claim 1, wherein the inner side pattern has a second circular shape that surrounds a plurality of inner patterns including the inner pattern.

15. The drum according to claim 14, wherein a diameter of the second circular shape is less than a diameter of the first circle shape.

16. A drum of a washing machine configured to receive laundry and to perform washing or dehydration, the drum comprising:

a circumferential surface that includes:

a plurality of outer side patterns that protrude from the circumferential surface toward an interior of the drum, each of the plurality of outer side patterns having a first circle shape, an inner side pattern that is recessed from the circumferential surface toward an exterior of the drum and that is surrounded by the plurality of outer side patterns, an inner pattern that is engraved in the circumferential surface and that is defined inside of the inner side pattern, a through hole defined at a center of the inner side pattern inside of the inner side pattern, and a sub through hole defined at a space between two outer side patterns of the plurality of outer side patterns that face each other, wherein the plurality of outer side patterns are arranged about the inner side pattern and spaced apart from one another, wherein the inner side pattern is spaced apart from the plurality of outer side patterns, the inner side pattern having a second circle shape that is different from the first circle shape, and wherein the inner pattern extends from a circumference of the inner side pattern to the through hole at the center of the inner side pattern.

17. The drum according to claim 16, wherein an area of the inner pattern is less than an area defined by an edge region of the inner side pattern.

18. A drum of a washing machine configured to receive laundry and to perform washing or dehydration, the drum comprising:

a circumferential surface that includes:

a plurality of outer side patterns that protrude from the circumferential surface toward an interior of the drum, each of the plurality of outer side patterns having a first circle shape, an inner side pattern that is recessed from the circumferential surface toward an exterior of the drum and that is surrounded by the plurality of outer side patterns, an inner pattern that is engraved in the circumferential surface and that is defined inside of the inner side pattern, a through hole defined at a center of the inner side pattern inside of the inner side pattern, and a sub through hole defined at a space between two outer side patterns of the plurality of outer side patterns that face each other, wherein the plurality of outer side patterns are arranged about the inner side pattern and spaced apart from one another, and wherein the inner side pattern is spaced apart from the plurality of outer side patterns.

19. The drum according to claim 18, wherein an area of the inner pattern is less than an area defined by an edge region of the inner side pattern.

* * * * *